US011541295B2

(12) United States Patent
Snyder

(10) Patent No.: US 11,541,295 B2
(45) **Date of Patent: *Jan. 3, 2023**

(54) GOLF SWING SPEED TRAINER

(71) Applicant: SPEED RING GOLF LLC, Louisville, KY (US)

(72) Inventor: Matthew Snyder, Louisville, KY (US)

(73) Assignee: SPEED RING GOLF LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/243,644

(22) Filed: Apr. 29, 2021

(65) Prior Publication Data

US 2021/0245029 A1 Aug. 12, 2021

Related U.S. Application Data

(63) Continuation of application No. 17/118,686, filed on Dec. 11, 2020, now Pat. No. 10,994,184.

(60) Provisional application No. 62/947,095, filed on Dec. 12, 2019.

(51) Int. Cl.

| | |
|---|---|
| ***A63B 69/36*** | (2006.01) |
| ***A63B 53/04*** | (2015.01) |
| ***A63B 15/00*** | (2006.01) |

(52) U.S. Cl.

CPC ..... *A63B 69/3632* (2013.01); *A63B 15/00* (2013.01); *A63B 53/04* (2013.01); *A63B 2053/0491* (2013.01)

(58) Field of Classification Search

CPC ..... A63B 69/3632; A63B 15/00; A63B 53/04; A63B 2053/0491

USPC ..... 473/256, 334–339

See application file for complete search history.

(56) References Cited

U.S. PATENT DOCUMENTS

| | | | |
|---|---|---|---|
| 1,167,387 | A | 1/1916 | Daniel |
| 2,002,108 | A | 5/1935 | Child |
| 2,715,026 | A | 8/1955 | Cadman |
| 2,950,919 | A | 8/1960 | Cadman |
| 3,136,546 | A | 6/1964 | Connolly |
| 3,190,651 | A | 6/1965 | Thomas |
| 3,351,346 | A | 11/1967 | Strahan |
| 3,414,260 | A | 12/1968 | Gust |

(Continued)

OTHER PUBLICATIONS

Diamond Tour Golf website; Accelerator Swing Speed Training System; https://www.diamondtour.com/accelerator-swing-speed-training-system.html, Oct. 28, 2019.

(Continued)

*Primary Examiner* — Sebastiano Passaniti

(74) *Attorney, Agent, or Firm* — Dawsey Co., LPA; David J. Dawsey

(57) ABSTRACT

A golf swing speed trainer for releasable attachment via a retainer to a shaft sleeve of a golf club shaft, including a head, a sleeve, and a weighting system. The trainer provides a highly customizable golf swing speed trainer that more accurately mimics the feel of a real club as a golfer works to increase their swing speed, without introducing any new bad habits. It allows a golfer to use their "gamer" shaft and grip during speed training, thereby increasing the user's familiarity with the trainer, which should result not only in increased swing speed but also improved consistency and accuracy.

20 Claims, 25 Drawing Sheets

(56) References Cited

U.S. PATENT DOCUMENTS 3,606,327 A * 9/1971 Gorman ..... A63B 53/0466 473/297
3,677,498 A 7/1972 Johnson et al.
3,743,297 A 7/1973 Dennis
3,759,527 A * 9/1973 Witherspoon ..... A63B 69/3632 473/330
3,817,534 A 6/1974 Carlino
3,874,660 A 4/1975 Brethen
4,052,075 A * 10/1977 Daly ..... A63B 53/04 473/338
4,195,842 A 4/1980 Coleman
4,444,396 A * 4/1984 Wendt ..... A63B 15/00 482/109
4,602,788 A 7/1986 Wendt
4,809,975 A 3/1989 Lee
5,121,925 A 6/1992 Blundo
5,209,481 A 5/1993 DeBack
5,215,307 A * 6/1993 Huffman ..... A63B 15/00 473/409
7,344,449 B2 3/2008 Hocknell et al.
7,530,900 B2 5/2009 Holt et al.
7,557,286 B2 7/2009 Capotosto
7,566,279 B2 7/2009 Nakashima
7,736,243 B2 6/2010 Sanchez et al.
7,931,542 B2 4/2011 Kusumoto
7,955,182 B2 6/2011 Thomas et al.
7,980,959 B2 7/2011 Morris et al.
7,997,997 B2 8/2011 Bennett et al.
8,046,899 B2 11/2011 Burch
8,096,895 B2 1/2012 Hocknell et al.
8,235,835 B2 8/2012 Soracco
8,235,836 B2 8/2012 Soracco et al.
8,353,781 B2 1/2013 DeShiell et al.
8,491,422 B2 7/2013 Deschesnes et al.
8,529,365 B1 * 9/2013 Davis ..... A63B 53/02 473/256
8,540,584 B1 * 9/2013 Sorenson ..... A63B 69/0002 473/219
8,616,995 B2 12/2013 Thomas et al.
8,747,248 B2 6/2014 Harvell et al.
9,144,720 B1 9/2015 Vrska et al.
9,174,097 B1 11/2015 Dacey et al.
9,320,947 B2 4/2016 Yamamoto
9,782,641 B2 10/2017 Boggs et al.
9,844,707 B2 * 12/2017 Davis ..... A63B 53/02
9,849,350 B2 12/2017 Dacey et al.
9,868,035 B2 1/2018 Clarke et al.
9,895,570 B2 2/2018 Shah
9,901,787 B2 2/2018 Boggs et al.
9,908,010 B2 3/2018 Boggs et al.
10,213,665 B1 2/2019 Day et al.
10,994,184 B1 * 5/2021 Snyder ..... A63B 53/04
2004/0009826 A1 1/2004 Aisenberg
2005/0261070 A1 * 11/2005 Jeong ..... A63B 60/04 473/219
2006/0142095 A1 * 6/2006 Glickman ..... A63B 53/065 473/340
2006/0154740 A1 * 7/2006 Liu ..... A63B 60/02 473/340
2007/0129164 A1 * 6/2007 Shimazaki ..... A63B 60/02 473/345
2007/0298904 A1 * 12/2007 Dworzan ..... A63B 53/0487 473/340
2008/0202317 A1 8/2008 Capotosto
2008/0254909 A1 10/2008 Callinan et al.
2012/0233838 A1 * 9/2012 Swist ..... A63B 60/00 29/428
2015/0005090 A1 1/2015 Parker
2015/0005091 A1 1/2015 Phillips
2017/0252627 A1 9/2017 Rosberger et al.
2017/0291090 A1 * 10/2017 Wang ..... A63B 69/3623
2021/0154551 A1 * 5/2021 Christiansen ..... A63B 69/3623

OTHER PUBLICATIONS

Kickstarter; Unlocked Golf; Swing Speed Trainer & Tripod by Patrick Rients; https://www.kickstarter.com/projects/hitbombs/unlocked-golf-swing-speed-trainer-and-tripod?ref=discovery&term=unlocked%20golf, Oct. 28, 2019.
Super Speed Golf trainer instruction manual.

* cited by examiner

GOLF SWING SPEED TRAINER

CROSS-REFERENCE TO RELATED APPLICATIONS

This application is a continuation of U.S. patent application Ser. No. 17/118,686, filed on Dec. 11, 2020, which claims the benefit of U.S. provisional patent application Ser. No. 62/947,095, filed on Dec. 12, 2019, all of which are incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to the field of golf training systems; particularly, to a golf swing speed training system.

BACKGROUND OF THE INVENTION

In the game of golf, it is desirable for a golfer to make the longest drives possible while maintaining consistency and accuracy. However, many golfers try to force the drive, swinging harder than they normally would; and as a result, both consistency and accuracy of the golf drives decrease. To try to overcome the limitations of trying of increasing the swing speed by brute force, various golf swing training devices have entered the market. Unfortunately, they prove to be limiting in weight customization, simulated shaft length and feel, and simulating the functional physics of a real golf club. As a result, the unfortunate golfer may learn bad habits from the poorly designed golf swing speed training devices.

The present invention advances the art by providing a highly customizable golf swing speed trainer that more accurately mimics the feel of a real club as they work to increase their swing speed, without introducing any new bad habits. Furthermore, the present invention allows a golfer to use their "gamer" shaft and grip during speed training, thereby increasing the user's familiarity with the trainer, which should result not only in increased swing speed but also improved consistency and accuracy.

BRIEF DESCRIPTION OF THE DRAWINGS

Without limiting the scope of the present invention as claimed below and referring now to the drawings and figures:

Figure 1:
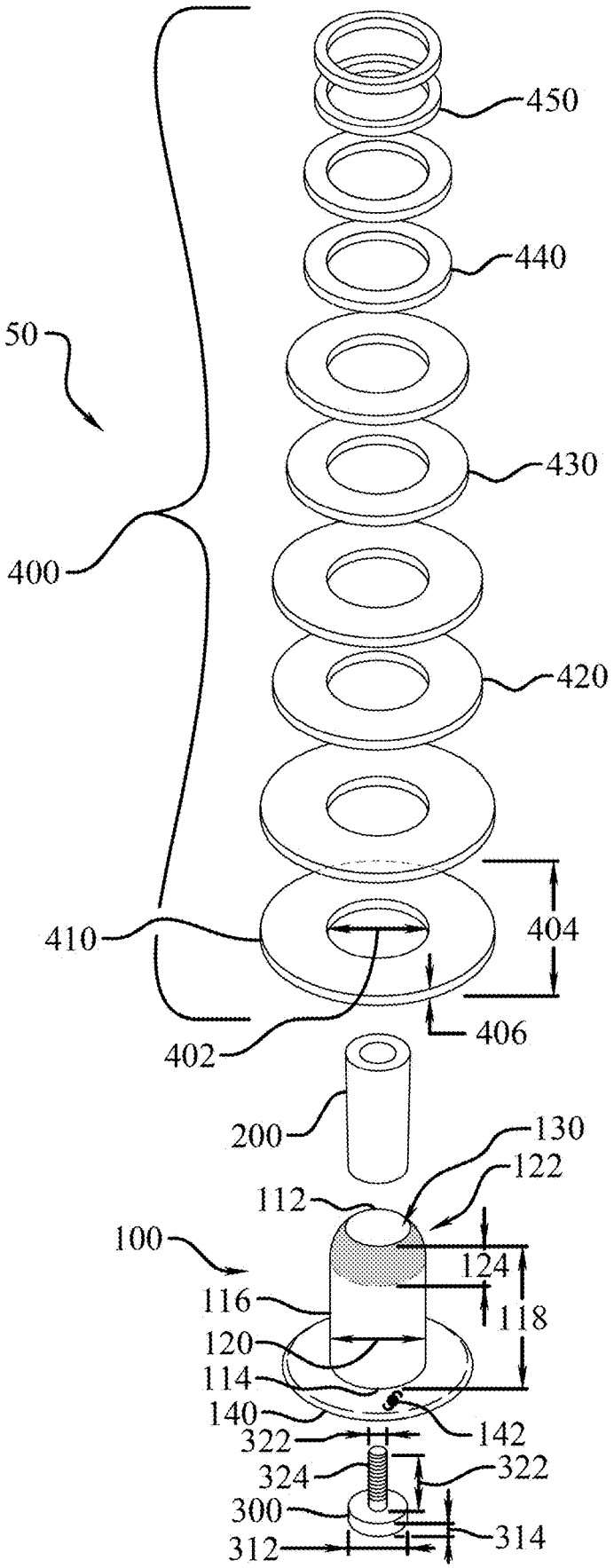
FIG. 1 shows an exploded isometric view of an embodiment of the golf swing speed trainer of the present invention.

These drawings are provided to assist in the understanding of the exemplary embodiments as described in more detail below and should not be construed as unduly limiting the present invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DESCRIPTION OF THE INVENTION

The swing speed trainer (50) of the instant invention enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

In the sport of golf, a golfer's swing speed is a major factor that determines how far a golf ball travels. However, many errant golf-swings are made because the golfer tries to over swing the club, thereby sacrificing consistency and accuracy. The current invention is designed to help a golfer increase their swing speed while maintaining club control.

Figure 8A:
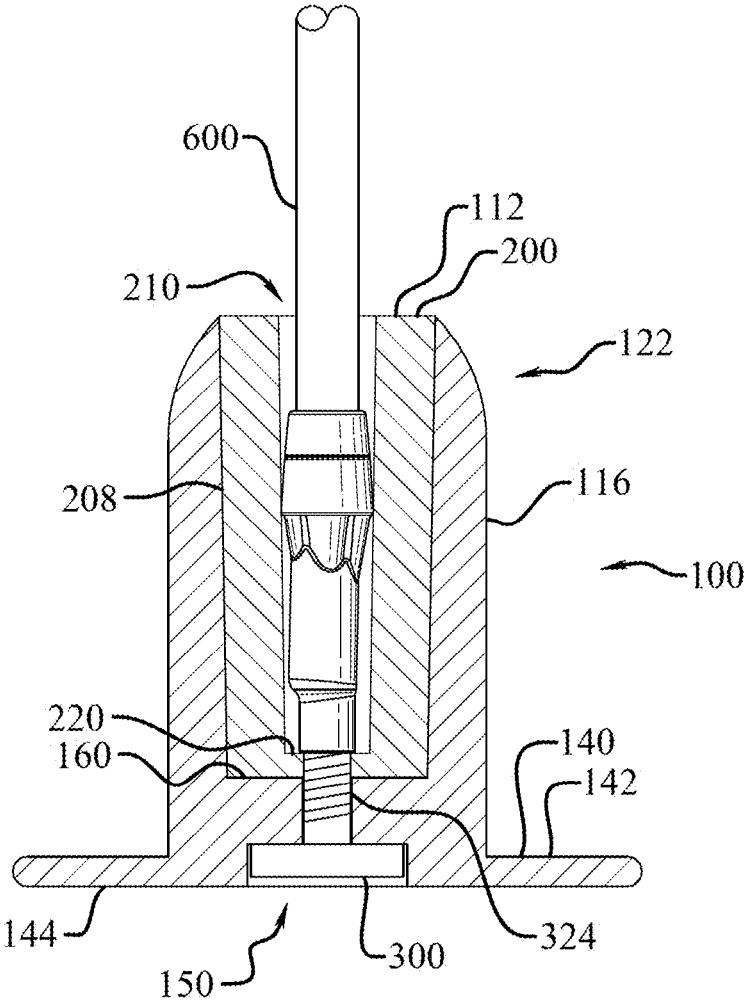
FIG. 8*a* shows a partial cross-sectional assembled view of an embodiment of head and sleeve in FIG. 7 with a shaft, shaft sleeve, and a retainer.
Figure 8B:
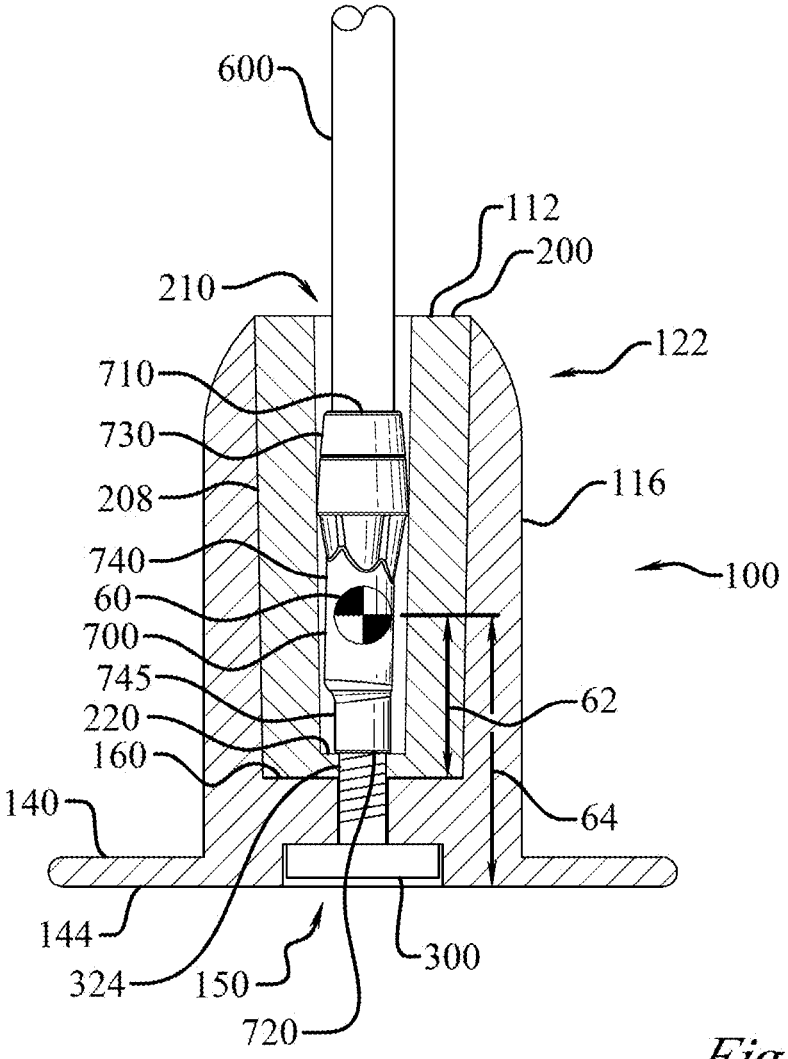
FIG. 8*b* shows a partial cross-sectional assembled view of an embodiment of head and sleeve with a shaft, shaft sleeve, and a retainer.
Figure 8C:
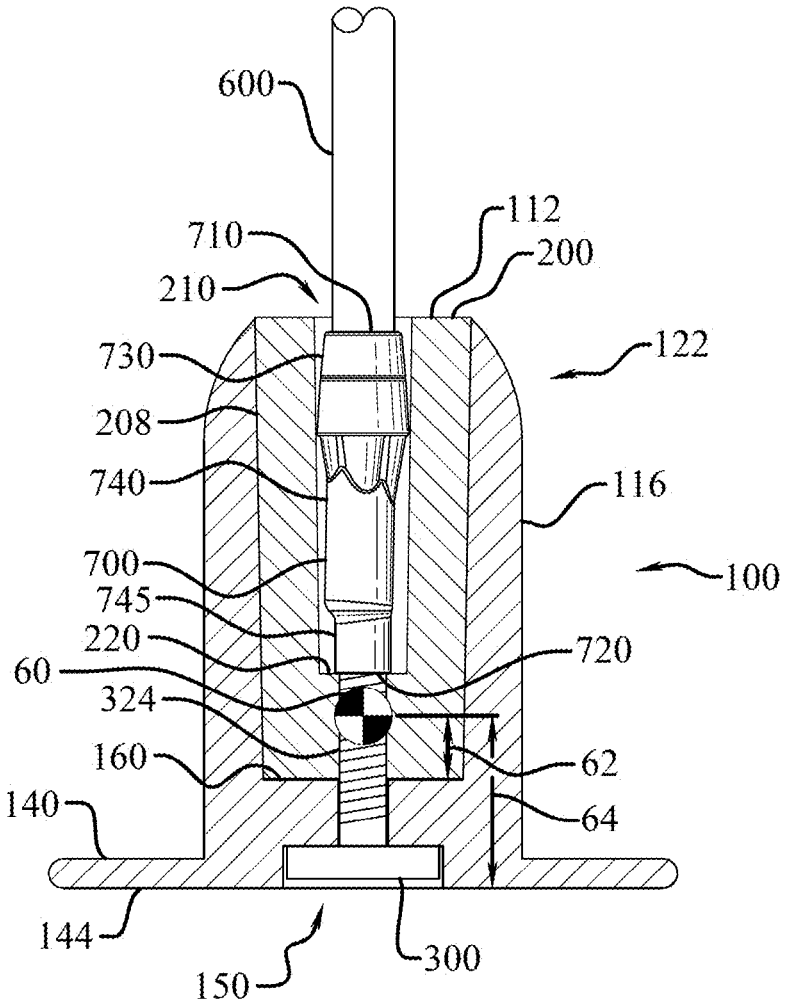
FIG. 8*c* shows a partial cross-sectional assembled view of an embodiment of head and sleeve with a shaft, shaft sleeve, and a retainer.

The swing speed trainer (50) includes a head (100), a sleeve (200), a retainer (300), and a weighting system (400), as illustrated in FIG. 1. The swing speed trainer (50) is releasably attached to a shaft (600), which in some embodiments includes a shaft sleeve (700). The shaft sleeve (700) may include a shaft sleeve proximal side (710), a shaft sleeve distal side (720), a shaft sleeve ferrule portion (730), and a shaft sleeve insert portion (740), which further includes a shaft sleeve insert threaded portion (745), as seen in FIGS. 8*b* and 8*c*. The shaft sleeve ferrule portion (730) is that portion of the shaft sleeve (700) that is normally exposed outside the hosel of a golf club head, while the shaft sleeve insert portion (740) is that portion that is normally inside the hosel, or bore, of a golf club head.

A benefit of the present swing speed trainer (50) is that it is designed to be installed on a golfer's existing golf club shaft. As one skilled in the art will appreciate, majority of drivers sold today include club head adjustability features, which generally consist of a sleeve mounted on the end of a shaft and configured such that a user can adjust the position of the sleeve within the golf club head to adjust the orientation of the club head with respect to the shaft, thereby changing the loft, face angle, and/or lie angle. Generally a golfer has made a significant investment in the purchase of their driver, often having also invested even more for a custom fitting service to determine the best club head and shaft configuration for the individual golfer's swing. Further, golfers are often very particular about the golf grip that they prefer, including the look, style, and size of the grip, as some golfers prefer mid-size grips, others prefer oversized grips, and still others may utilize orthopedic grips, which are often referred to as arthritic grips. Therefore, it only makes sense that the golfer would ideally use the shaft that they know and love when practicing their golf swing, which includes what is commonly referred to as speed training. After all, the feel and flex of a shaft influences the golf swing, particularly if it varies significantly from that which is comfortable, or known, to the golfer; and the same is also true with respect to the grip.

Figure 2:
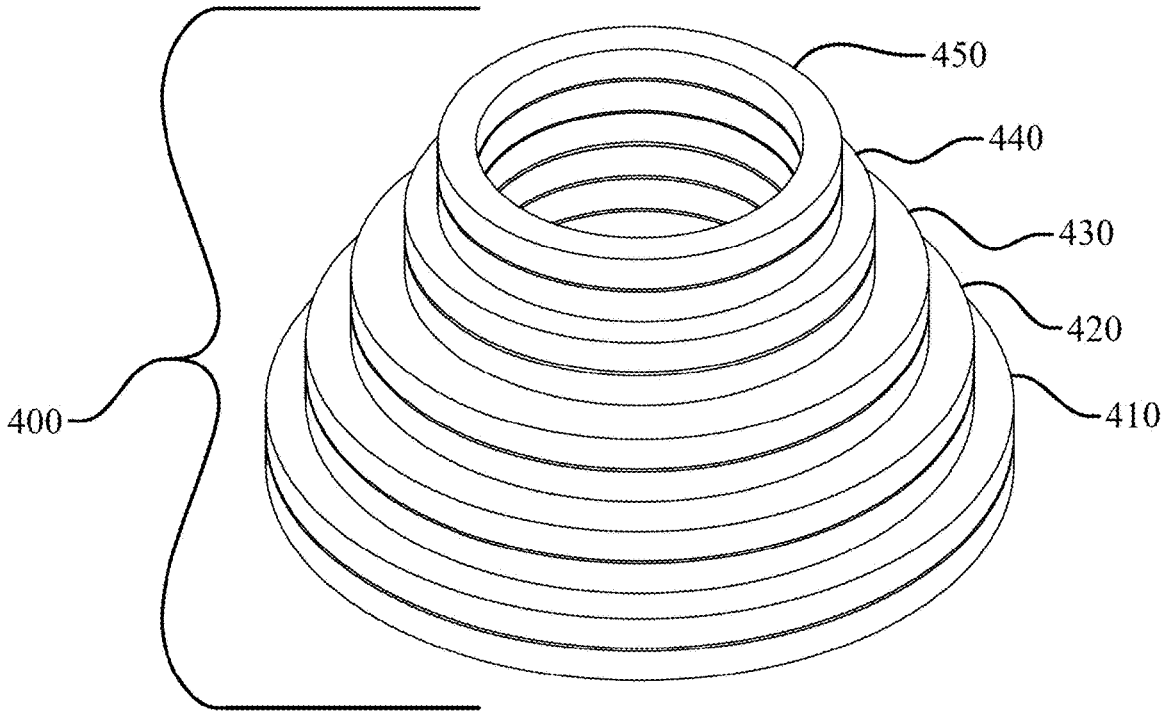
FIG. 2 shows a partially exploded isometric view of the embodiment of FIG. 1.
Figure 2:
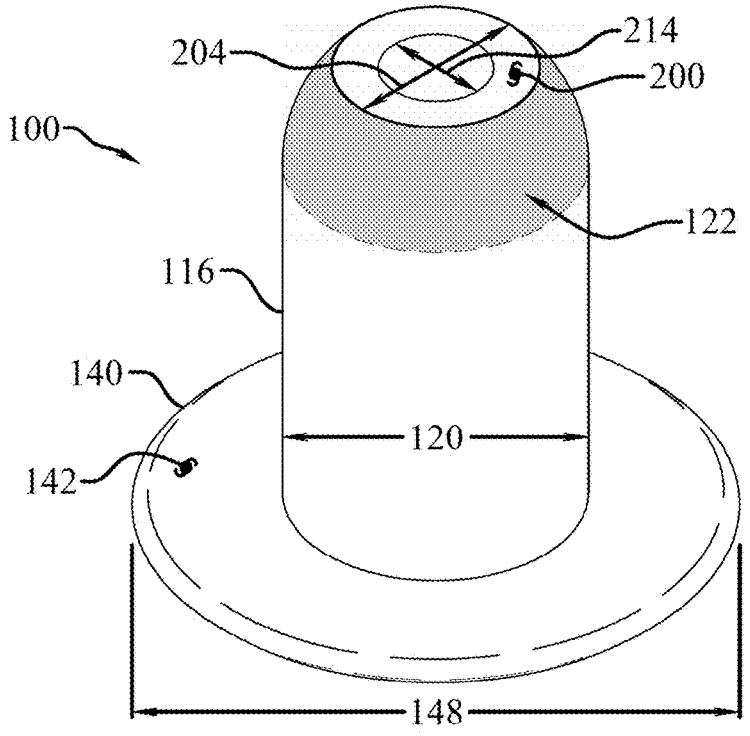
Figure 4:
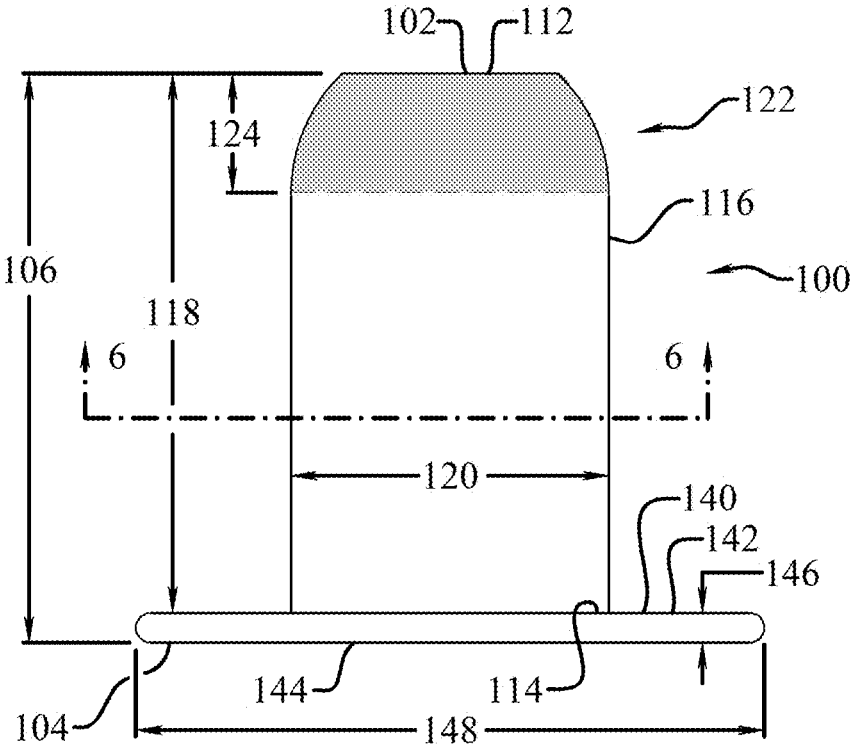
FIG. 4 shows a front elevation view of the head of the present invention

The head (100) may include a spindle (110), a spindle bore (130), a support plate (140), a retainer recess (150), a spindle bore flange (160), and/or a spindle bore flange aperture (170), as seen in FIGS. 1, 2, 4 and 5. The head (100) has a head proximal end (102), a head distal end (104), and a head length (106), all seen in FIG. 4. The spindle (110), which is not limited to the round cross-sectional profile illustrated in the figures, may include a spindle proximal side (112), a spindle distal side (114), a spindle side wall (116), a spindle length (118), a spindle diameter (120), and/or a spindle weight feed region (122) having a feed region length (124). The spindle weight feed region (122), seen best in FIG. 4, helps the end user install the weighting system's (400) weights on the head (100) via a smooth radius in some embodiments, and a taper or chamfer in other embodiments. In one embodiment, the spindle weight feed region (122) has convex profile, as shown in FIGS. 1, 2 and 4. In another embodiment, the spindle weight feed region (122) has a concave profile, while in a further embodiment the spindle weight feed region (122) has a straight tapering profile. The spindle length (118) is at least 30 mm, and at least 40 mm, 50 mm, 60 mm, and 70 mm in further embodiments. However, the spindle length (118) is no more than 100 mm, and no more than 90 mm, 80 mm, and 75 mm in further embodiments. When present, the feed region length (124) is 5-40% of the spindle length (118), and 10-30% in a further embodiment, and 15-25% in still another embodiment. The feed region length (124) is preferably at least 5 mm, and at least 9 mm, and at least 13 mm in further embodiments.

Figure 5:
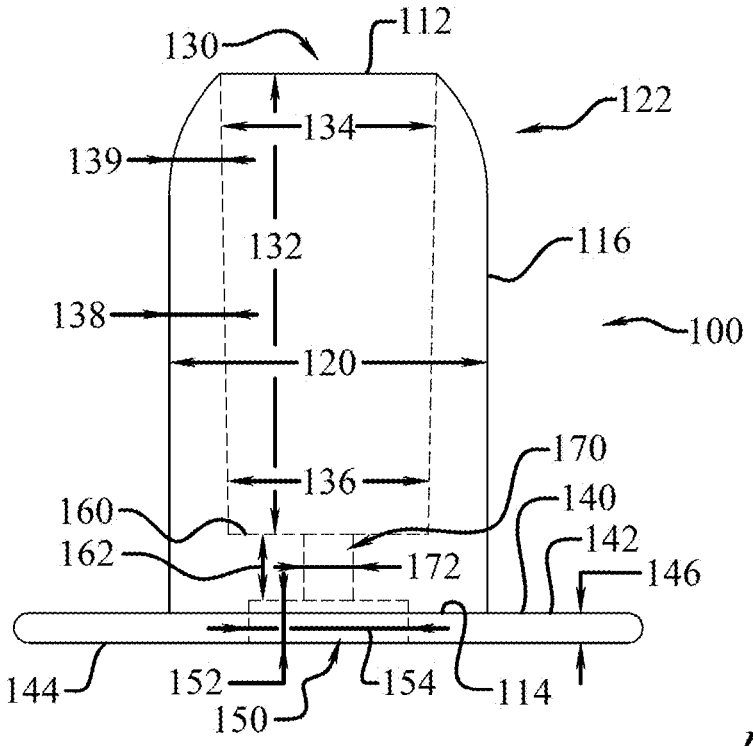
FIG. 5 shows a partial cross-sectional view of the embodiment of the head in FIG. 4.

The spindle bore (130) may include a spindle bore depth (132), a spindle bore proximal diameter (134), a spindle bore distal diameter (136), a spindle bore to spindle sidewall thickness (138), and a spindle bore to feed region thickness (139), as illustrated in FIG. 5. In one embodiment the spindle bore proximal diameter (134) is greater than the spindle bore distal diameter (136) by at least 1.0 mm in one embodiment, and at least 1.5 mm in another embodiment, while in still a further embodiment the spindle bore proximal diameter (134) is equal to the spindle bore distal diameter (136). In one embodiment the spindle bore proximal diameter (134) is 15-30 mm, while in another embodiment it is 18-27 mm, and in yet a further embodiment it is 21-25 mm. The spindle bore to spindle sidewall thickness (138) is at least 1.5 mm, and at least 2.5 mm in another embodiment, and at least 3.5 mm in yet another embodiment. The spindle bore to spindle sidewall thickness (138) is no more than 12 mm, and no more than 10 mm in a further embodiment, and no more than 8 mm in yet another embodiment. In one embodiment the spindle sidewall thickness (138) varies throughout the length of the spindle (110), and in one embodiment varies by at least 1 mm. The spindle bore to feed region thickness (139) varies by at least 2 mm, and at 3 mm in another embodiment, and at least 4 mm in still a further embodiment.

Figure 8D:
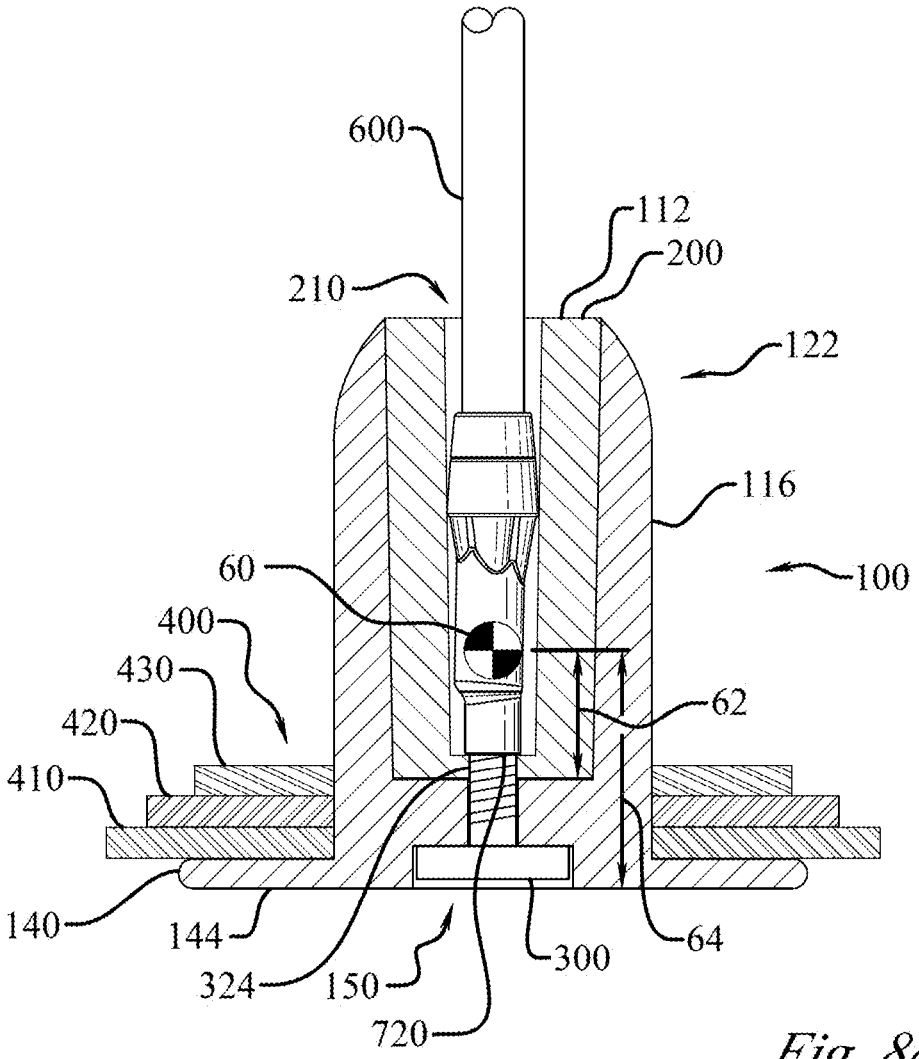
FIG. 8*d* shows a partial cross-sectional assembled view of an embodiment of head and sleeve with a shaft, shaft sleeve, a retainer, and three weights.

Some embodiments of the head (100) include a support plate (140), as seen in FIGS. 1, 2, 4-9, to retain weights on the head (100), as seen in FIG. 8*d*. The support plate (140) may include a plate proximal side (142); a plate distal side (144); a plate thickness (146); and a plate diameter (148). The support plate (140) may be located at the spindle distal side (114), as seen in FIG. 5, and it may be approximately perpendicular to the axis of the spindle bore (130), however in further embodiments the support plate (140) may be offset from the spindle distal side (114) and may be angled with respect to the axis of the spindle bore (130). The plate diameter (148) is at least 30 mm, and at least 40 mm in a further embodiment, and at least 50 mm in still another embodiment, and 60-70 mm in another embodiment. The plate thickness (146) is at least 1.5 mm, and at least 2.5 mm in another embodiment, and at least 3.5 mm in still a further embodiment. The plate thickness (146) is no more than 12 mm, and no more than 10 mm in another embodiment, and no more than 8 mm in still a further embodiment.

Figure 6:
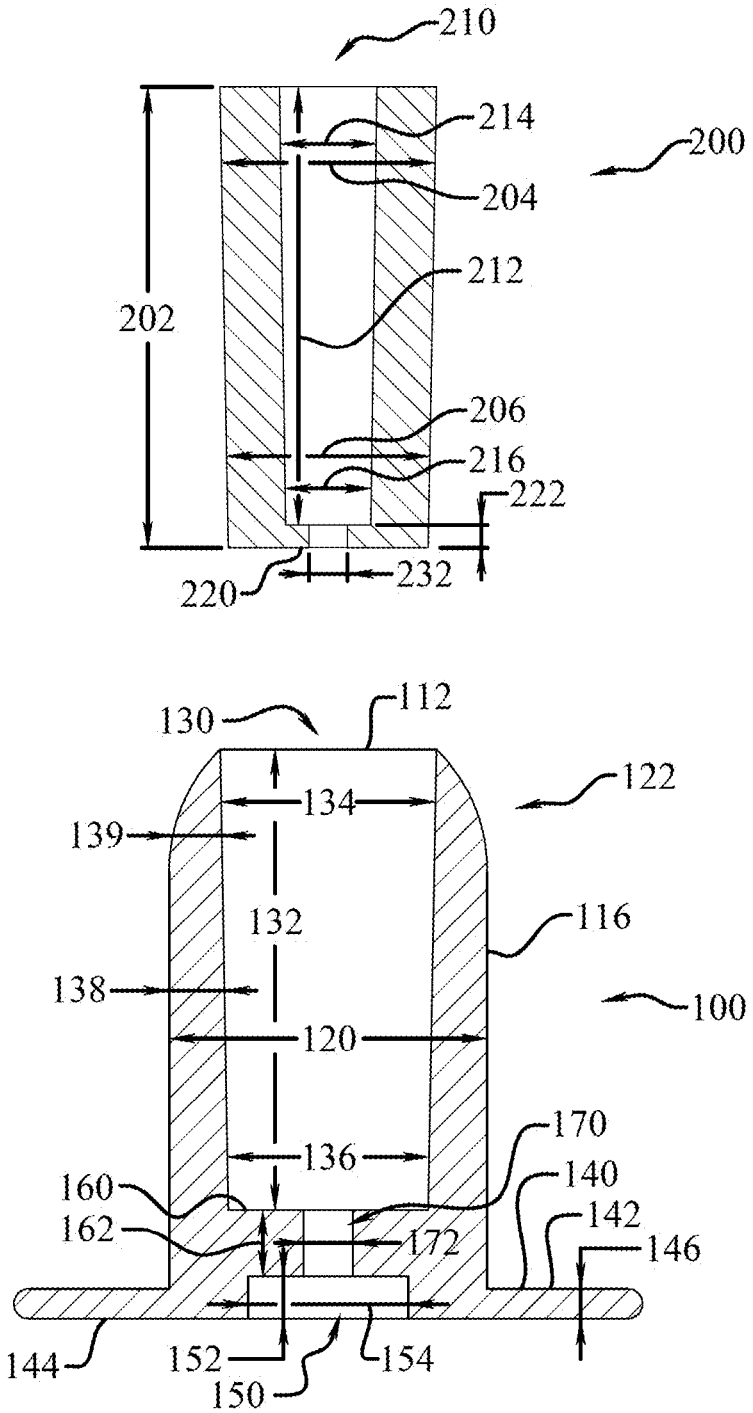
FIG. 6 shows a cross-sectional exploded view of an embodiment of head and sleeve.
Figure 7:
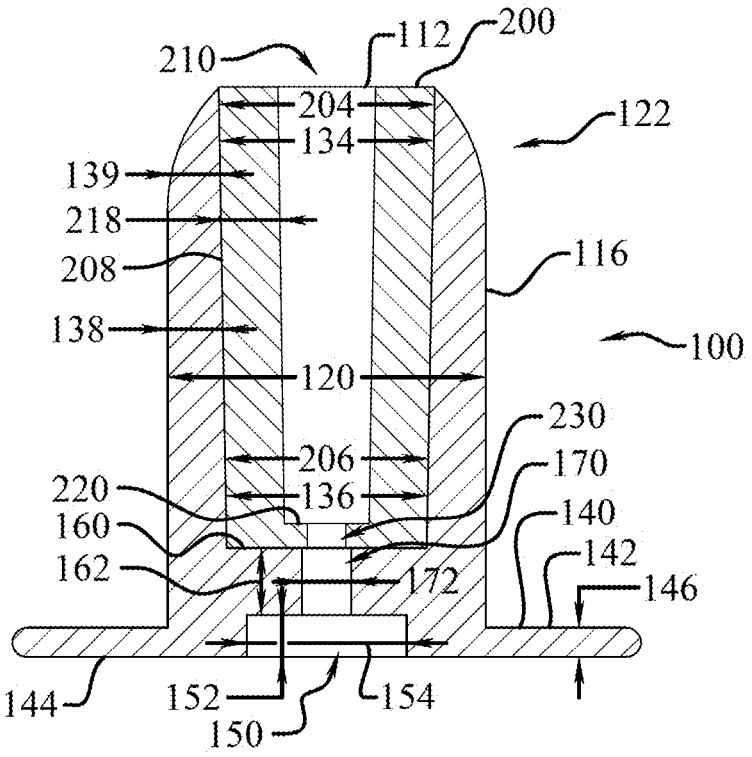
FIG. 7 shows a cross-sectional assembled view of an embodiment of head and sleeve.

The retainer recess (150) has a retainer recess depth (152), and a retainer recess diameter (154), illustrated in FIGS. 5 and 6. The spindle bore flange (160) has a spindle bore flange thickness (162). Lastly, the spindle bore flange aperture (170) has a spindle bore flange aperture diameter (172), as seen in FIGS. 5 and 6, that is at least 2 mm, and 3 mm, 4 mm, and 5 mm in other embodiments; and no more than 12 mm, 10 mm, and 8 mm in further embodiments. The head (100) may be composed of, but not limited to: metal, including, but not limited to, aluminum alloys, titanium alloys, magnesium alloys, and steel alloys; plastics; rubber; composite materials; or a combination thereof. The spindle bore flange thickness (162) is at least 50% of the spindle bore to spindle sidewall thickness (138), and at least 70% in another embodiment, and at least 90% in still a further embodiment.

The head (100) may incorporate other features designed to retain the weights on the head (100) in lieu of, or in addition to, the support plate (140). For example, the spindle side wall (116) may include one or more channels that cooperate with and receive a projection extending from an internal opening in a weight, such as a weight indexing boss (407) illustrated in FIG. 12*a*. In such an embodiment the channel(s) does not extend the full length of the head (100) so that the projection eventually contacts the end of the channel. Alternatively, the spindle side wall (116) may include one or more projections. For instance, in one embodiment the spindle side wall (116) includes two projections located 180 degrees apart and these projections prevent the weight from sliding off the end of the head (100), in other words the projections can be thought of as simply pieces of a support plate instead of a full 360 degree support plate, while a further embodiment includes four projections located 90 degrees apart around the circumference of the head (100). In another embodiment the projections do not act as a stop but rather as a key, or rail, that is received in a keyway formed in the internal opening of the weight, such as the weight indexing cog (408) illustrated in FIG. 11*c*. The end of the key would incorporate an additional step or projection to retain the weight on the head, while also serving to prevent the weight from rotating during use.

Now referring to the sleeve (200) as seen in FIGS. 1 and 6-8*i*, the sleeve (200) is designed to receive at least a portion of the shaft sleeve (700), which may include all of, or only a portion of the shaft sleeve insert portion (740), or may also include all or, or only a portion of, the ferrule portion (730). The sleeve (200) may include a sleeve length (202), a sleeve proximal diameter (204), a sleeve distal diameter (206), and a sleeve side wall (208). In one embodiment the sleeve length (202) is substantially the same as the spindle bore depth (132) into which it is inserted during assembly. The sleeve (200) also has a sleeve bore (210) having a sleeve bore depth (212), a sleeve bore proximal diameter (214), a sleeve bore distal diameter (216), and a sleeve bore to sleeve sidewall thickness (218). The spindle bore depth (132) is at least 28 mm, and at least 30 mm in another embodiment, and at least 33 mm in yet a further embodiment. The spindle bore depth (132) is no more than 80 mm, and no more than 70 mm in another embodiment, and no more than 60 mm in yet a further embodiment. The sleeve proximal diameter (204) and the sleeve distal diameter (206) preferably match the spindle bore proximal diameter (134) and the spindle bore distal diameter (136), plus or minus 2 mm. In one embodiment at least a portion of the sleeve diameter is greater than a portion of the spindle bore diameter, while in a further embodiment the sleeve diameters are at least 0.5 mm greater than the spindle bore diameters. The thickness of the sleeve side wall (208) is at least 2 mm, and at least 4 mm in a further embodiment; and thickness of the sleeve side wall (208) is no more than 10 mm, and no more than 8 mm in a further embodiment.

In one embodiment, the sleeve bore depth (212) falls within the range of 30-60 mm. In another embodiment, the sleeve bore depth (212) falls within the range of 35-55 mm. In still yet another embodiment, the sleeve bore depth (212) falls within the range of 40-50 mm. Furthermore, at least a portion of the sleeve bore diameter, whether it be the sleeve bore proximal diameter (214), the sleeve bore distal diameter (216), or somewhere in between, is equal to, or less than, a dimension of a portion of the shaft sleeve (700), thereby ensuring a tight fit and reducing stress on the shaft sleeve (700) during use. At least a portion of the sleeve (200) is composed of compressible material so that the shaft sleeve (700) may be forced into the sleeve (200) despite having a cross-sectional dimension larger than the sleeve bore diameter to achieve a tight fit. While a portion of the sleeve (200) is compressible, it is not so compliant that it compresses significantly during use and allows the shaft axis to deviate significantly from the axis of the spindle bore (130), because doing would place high stress on the shaft sleeve insert threaded portion (745) of the shaft sleeve (700), the spindle bore flange aperture (170), and the retainer (300). In one embodiment the compressible portion of the sleeve (200) has a durometer of 50-100 Shore A, and 60-90 Shore A in a further embodiment, and 65-85 Shore A in still another embodiment. Another embodiment has the compressible portion of the sleeve (200) with a durometer of 20-80 Shore D, and 30-70 Shore D in a further embodiment, and 40-60 Shore D in yet another embodiment. In one embodiment the sleeve (200) is formed of a single homogenous material, while in another embodiment the sleeve (200) contains a compressible liner having the previously disclosed properties and a thickness of at least 2 mm, and at least 4 mm in a further embodiment. In an embodiment the hardness preferably allows a user to force the shaft sleeve (700) into the sleeve (200) under an axial load of 20 lbf or less, and 15 lbf or less in a further embodiment, and 10 lbf or less in yet another embodiment. In one embodiment the spindle bore proximal diameter (134) is less than the spindle bore distal diameter (136) to facilitate the aforementioned attributes.

The sleeve (200) may include a sleeve bore flange (220) having a sleeve bore flange thickness (222), as seen in FIG.

6. The sleeve bore flange thickness (222) helps isolate the end of the shaft sleeve (700) and keeps it from coming into direct contact with the rigid spindle bore flange (160). The sleeve bore flange thickness (222) is at least 1.5 mm, and at least 2.5 mm in a further embodiment. At least a portion of the sleeve bore flange (220) is compressible, thereby facilitating the compressibility necessary to accommodate various shaft sleeve (700) sizes, while controlling deviation of the shaft axis during use, yet not placing excessive stress on the threaded portion of the shaft sleeve (700) or the retainer (300). Furthermore, in some embodiments the sleeve (200) has a sleeve bore flange aperture (230) having a sleeve bore flange aperture diameter (232), as seen in FIG. 6. The sleeve (200) may be composed of, but not limited to rubber, polymers, elastomeric materials, composites, cork, felting, metals, or a combination thereof. As illustrated throughout, the sleeve (200) may be a separate component for ease of attachment, however it may also be an integral part of the head (100) or a separate component but permanently attached to the head (100).

The retainer (300) may include a retainer head (310) and a retainer shank (320). The retainer head (310) has a retainer head diameter (312) and a retainer head length (314). The retainer shank (320) has a retainer shank length (322), a retainer shank diameter (324), and retainer threads (326), as seen in FIG. 1. The retainer head diameter (312) is less than the retainer recess diameter (154) and the retainer head length (314) is less than the retainer recess depth (152) so that the retainer head (310) sits flush or recessed within the retainer recess (150). The retainer shank (320) passes through the spindle bore flange aperture (170) and the sleeve bore flange aperture (230) and engages the end of a shaft sleeve (700), illustrated in FIGS. 1, and 8. Additionally, the retainer shank diameter (324) is less than the spindle bore flange aperture diameter (172) and the sleeve bore flange aperture diameter (232) to allow the retainer shank (320) to pass through the spindle bore flange aperture (170) and the sleeve bore flange aperture (230), while accommodating some shaft axis deviation. The retainer shank length (322) is longer than the sum of the spindle bore flange thickness (162), the sleeve bore flange thickness (222), and at least ½ the length of the shaft sleeve insert threaded portion (745). Most modern golf club heads are designed so that the retainer, that secures the club head to the shaft sleeve, remains attached to the club head even when fully disengaged from the shaft sleeve. Therefore, the kit, or system, may come with at least one retainer (300) having a size and thread pattern to match that of popular golf club brands. However, there is not a standard size, thread pattern, or engagement recess used by each of the golf club manufacturers. Therefore, in one embodiment the kit includes at least two retainers (300) having different thread patterns, while in another embodiment includes at least two retainers (300) having different diameters, while yet a further embodiment includes at least two retainers (300) having different end engagement recesses, and still another embodiment includes at least two retainers (300) formed of different materials and/or having different weights.

Figure 11A:
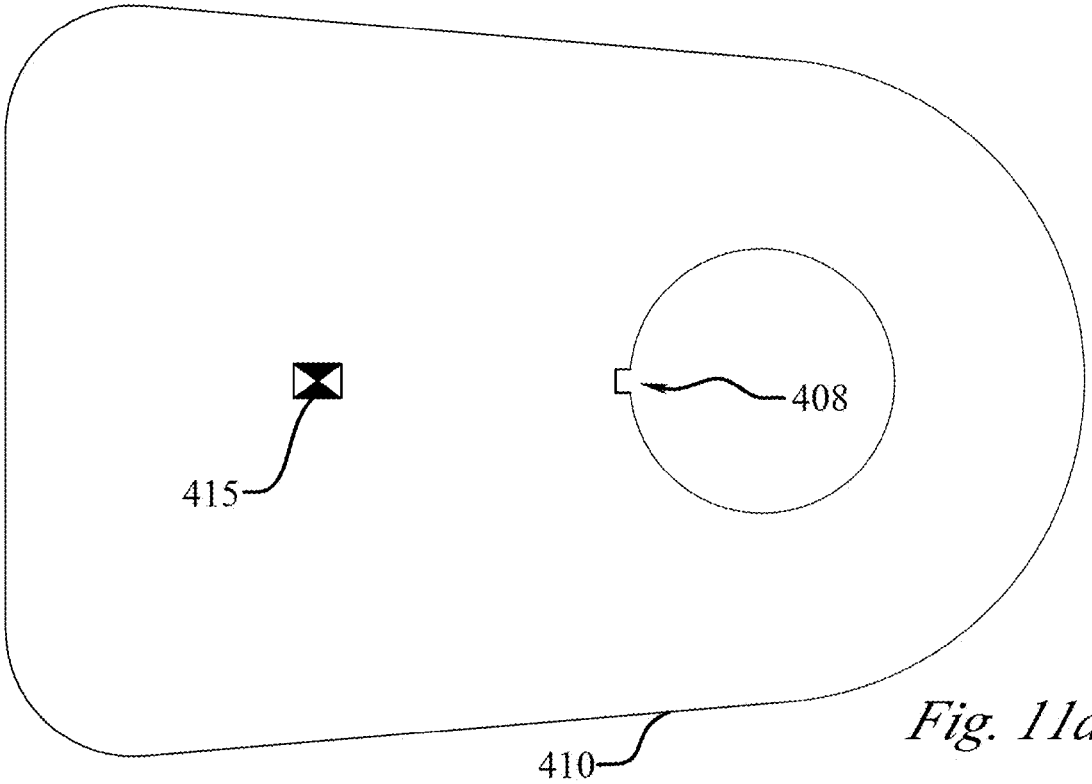
FIG. 11*a* shows a top plan view of a weight embodiment of the present invention.
Figure 11B:
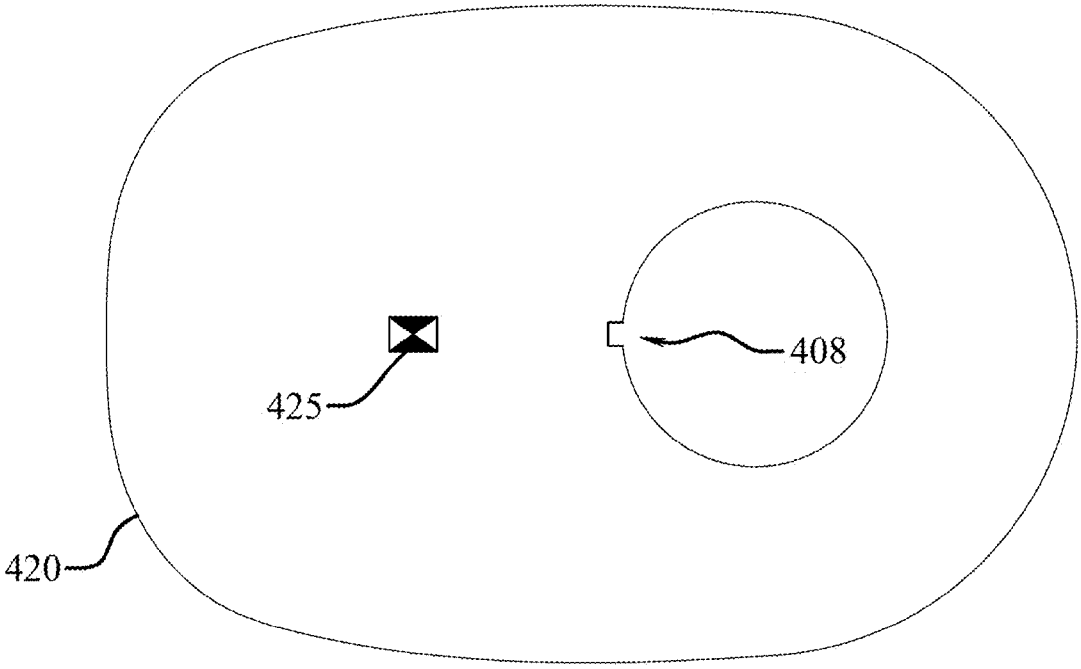
FIG. 11*b* shows a top plan view of a weight embodiment of the present invention.
Figure 11C:
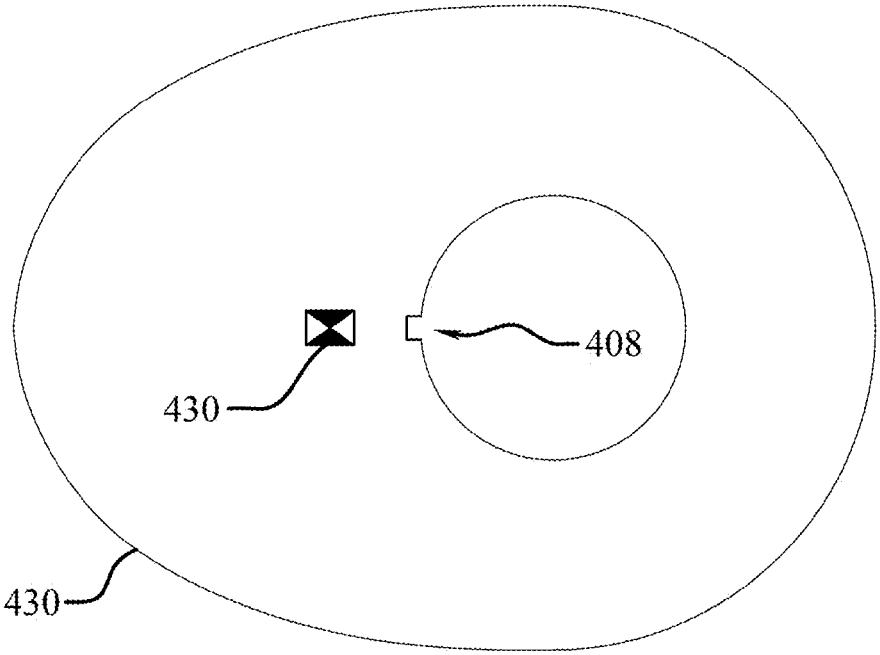
FIG. 11*c* shows a top plan view of a weight embodiment of the present invention.
Figure 12A:
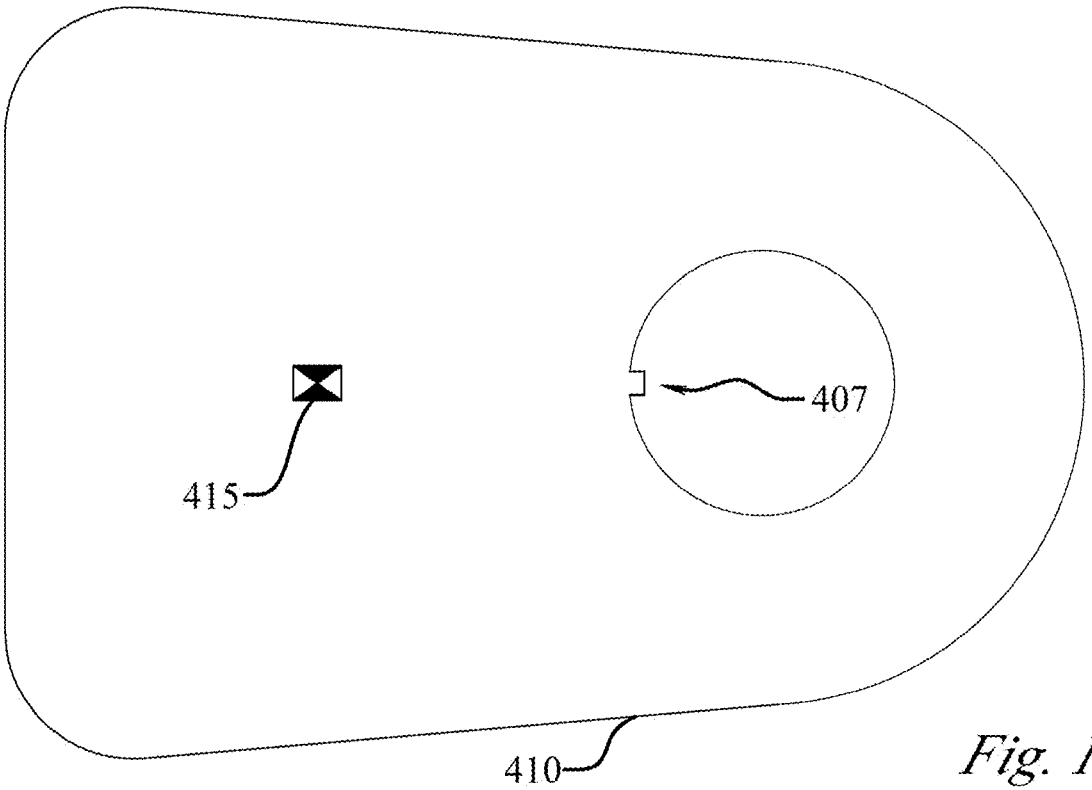
FIG. 12*a* shows a top plan view of a weight embodiment of the present invention.
Figure 12B:
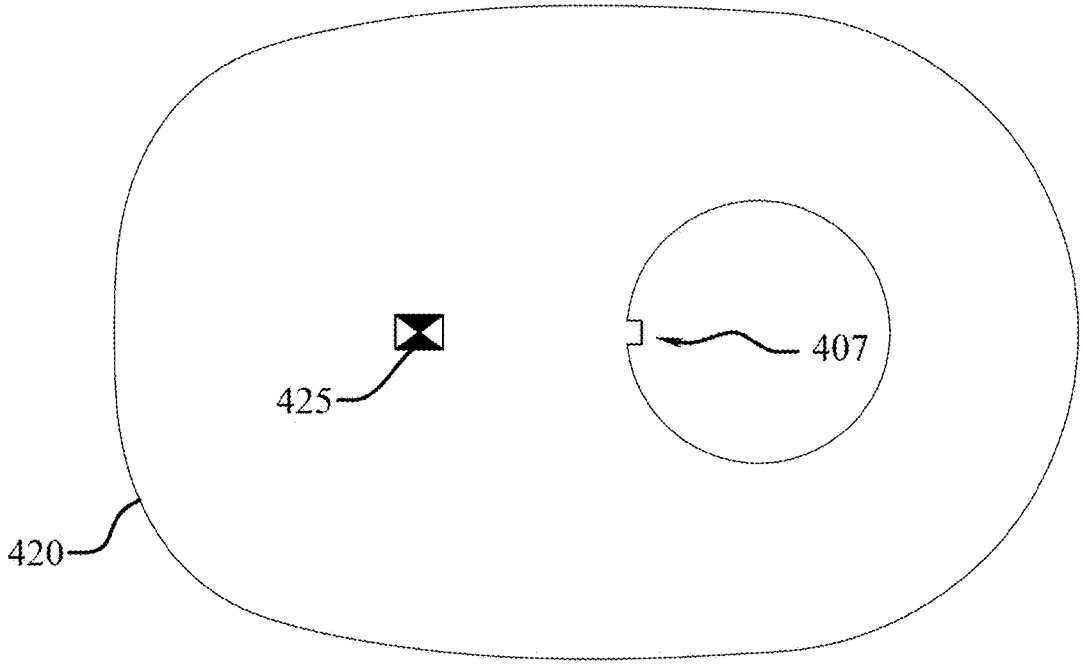
FIG. 12*b* shows a top plan view of a weight embodiment of the present invention.
Figure 12C:
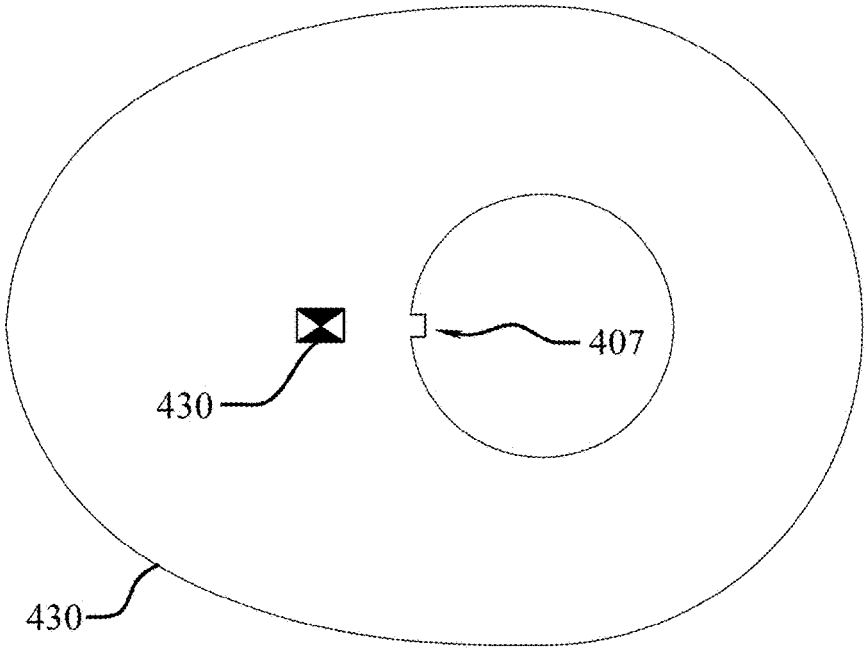
FIG. 12*c* shows a top plan view of a weight embodiment of the present invention.

As seen in FIG. 1, the weighting system (400) may include a first weight (410), a second weight (420), a third weight (430), a fourth weight (440), and a fifth weight (450), and any combination thereof. In one embodiment the weights encircle the spindle (110) a full 360 degrees, however this is not required in all embodiments. Each of the weights has a weight inner diameter (402), a weight outer diameter (404), and a weight thickness (406), as seen in FIG. 1. Additionally in some embodiments the weights may include a weight indexing boss (407), which is a projection or rail, as seen in FIGS. 12*a*-14*c*, that interfaces with a indexing cog, or keyway/channel, formed in the spindle side wall (116), not shown. In another embodiment, the weights may include a weight indexing cog (408), or keyway/channel, as shown in FIGS. 11*a*-11*c* that interface with a indexing boss, which is a projection or rail, located on the spindle side wall (116), not shown. The weight indexing boss (407) may further have an enlarged head that is captured in an enlarged base of the keyway/channel with a narrower conduit extending to the exterior surface of the spindle (110). For instance, the weight indexing boss (407) may be T-shaped whereby the head of the "T" is captured by the enlarged base and the stem of the "T" projects outward from the keyway/channel. In fact, the weight may simply be a wider extension of the stem of the "T" extending away from the spindle (110), and in some embodiments containing a higher density weight toward the opposite end to assist in shifting the system center of gravity (60) away from the longitudinal axis of the spindle bore (130). In this example the enlarged head weight indexing boss (407) is fed onto the spindle (110) at the spindle proximal side (112) at which point is enters the complimentarily shaped keyway/channel and is advanced toward the spindle distal side (114).

The weight inner diameter (402) is slightly larger than the spindle diameter (120) to allow the spindle (110) to pass through the weight inner diameter (402) aperture, while at the same time preventing excess movement of the weights on the spindle (110) during a practice swing. The weights of the weighting system (400) may be composed of, but not limited to polymers, plastic, rubber, composites such as composite materials, metal, alloys, wood, stone, leather; or a combination thereof. In another embodiment, the weighting system (400) may be further composed of magnetic rubber material that may be attracted to one another and/or the head (100), or may simply incorporate a distinct magnet(s) within the weight(s), thereby preventing excess movement of the weights during usage. FIG. 1 shows a set of two for each of the first weight (410), a second weight (420), a third weight (430), a fourth weight (440), and a fifth weight (450), however other embodiments may incorporate a single weight of at least two of the weights, at least three of the weights, at least four of the weights, or all five of the weights to obtain the weight relationships disclosed. The spindle diameter (120) is at least 15 mm in an embodiment, at least 20 mm in a further embodiment and at least 25 mm in yet another embodiment. The spindle diameter (120) is preferably no more than 60 mm, and no more than 50 mm in another embodiment, and no more than 40 mm in still a further embodiment.

In one embodiment using paired weights, the first weight (410) may have a weight in the range of 16-30 grams, and 18-26 grams in another embodiment, and 19-24 grams in yet a further embodiment. Similarly, the second weight (420) may have a weight in the range of 11-24 grams, and 13-20 grams in another embodiment, and 15-18 grams in yet a further embodiment. Likewise, the third weight (430) may have a weight in the range of 7-15 grams, and 8-12 grams in another embodiment, and 9-12 grams in yet a further embodiment. Further, the fourth weight (440) may have a weight in the range of 3-10 grams, and 4-9 grams in another embodiment, and fourth3-7 grams. Lastly, the fifth weight (450) may have a weight in the range of 0.5-5 grams, and 1-4 grams in another embodiment, and 1.5-3 grams in yet a further embodiment.

In one embodiment using non-paired weights, the first weight (410) may have a weight in the range of 32-60 grams, and 36-52 grams in another embodiment, and 38-48 grams in yet a further embodiment. Similarly, the second weight (420) may have a weight in the range of 22-48 grams, and 26-40 in another embodiment, and 30-36 grams in yet a further embodiment. Likewise, the third weight (430) may have a weight in the range of 14-30 grams, and 16-24 grams in another embodiment, and 18-24 grams in yet a further embodiment. Further, the fourth weight (440) may have a weight in the range of 6-20 grams, and 8-18 grams in another embodiment, and 6-22 grams in yet a further embodiment. Lastly, the fifth weight (450) may have a weight in the range of 1-10 grams, and 2-8 grams in another embodiment, and 3-6 grams in yet a further embodiment.

The swing speed trainer (50) may be configured to achieve the goals associated with several distinct training levels. Generally speed training of the golf swing is associated with tee shots hit with a driver, therefore the bulk of this disclosure will focus on drivers and the configurations in Table 1 below, however one skilled in the art will appreciate how the disclosure is applicable to all other golf clubs including, but not limited to, 3-woods, 5-woods, and 3-hybrid, and their related disclosure in the table below. As previously disclosed with respect to ranges for the various weights, the mass of the head (100), the sleeve (200), and the retainer (300) also fall into preferred ranges, also disclosed in Tables 2 and 3, to achieve the desired configurability of the system to achieve the necessary flexibility to address multiple desired system mass ranges.

Now referring to Table 1 and using the "driver" row as an example, the typical head weight of a driver is 180-215 grams. In order to safely and effectively increase a golfer's swing speed the golfer should practice with the swing speed trainer (50) configured to achieve two distinctly different weight configurations, and in a further embodiment—three distinctly different weight configurations. The first configuration, namely "configuration A" in the Table 1, is intended to be significantly lighter than the head weight of the driver that has become familiar to the user, which in one embodiment means approximately 15-30% less. In this configuration the load is significantly reduced and the golfers swing speed should increase in proportion to the % reduction in mass; specifically, in one embodiment the practice swing speed should increase over the user's original swing speed (using their driver) according to the following:

(a) % increase of new configuration A swing speed>0.75 times the % of mass reduction (b) % increase of new configuration A swing speed<1.25 times the % of mass reduction Therefore, if configuration A is 20% less, then the practice swing speed associated with this configuration should be 15-25% higher than the original swing speed.

Next, the second configuration, namely "configuration B" in Table 1, is intended to be heavier than the head weight of the driver that has become familiar to the user, which in one embodiment means approximately 5-25% more. In this embodiment the load is increased and strength is built as the golfer tries to maintain the swing speed developed while training with configuration A, however doing do will be difficult or impossible. However, the user will still be able to achieve a reliable swing that is under control with a swing speed that is higher than the user's original swing speed. In one embodiment the practice swing speed should increase over the user's original swing speed (using their driver) according to the following:

(a) % increase of new configuration B swing speed>0.25 times the % of mass increase (b) % increase of new configuration B swing speed<1.00 times the % of mass increase Therefore, if configuration B is 10% more than the head weight of the driver, then the practice swing speed associated with this configuration should be 2.5-10% higher than the original swing speed.

Further, another embodiment incorporates a "configuration C", which as seen in Table 1, is intended to be lighter than the head weight of the driver that has become familiar to the user, but heavier than configuration A. Thus, in one embodiment the weight of configuration C is approximately 5-14% less than the head weight of the driver that has become familiar to the user. In this configuration the load is reduced and the golfers swing speed should increase in proportion to the % reduction in mass; specifically, in one embodiment the practice swing speed should increase over the user's original swing speed (using their driver) according to the following:

(a) % increase of new configuration C swing speed >0.95 times the % of mass reduction (b) % increase of new configuration C swing speed <1.75 times the % of mass reduction Therefore, if configuration C is 10% less, then the practice swing speed associated with this configuration should be 9.5-17.5% higher than the original swing speed.

The total system weight of swing speed trainer (50) includes the sum of the individual weights of the head (100), sleeve (200), retainer (300), and all of the weight (410, 420, 430, 440, and/or 450) mounted on the head (100). In one embodiment the swing speed trainer (50) is a kit and includes at least 3 weights that may be interchangeably placed on, or taken off, the head (100) to achieve the weight ranges illustrated in Table 1 for embodiment "a" of both configuration A and configuration B, while in a further embodiment the ranges are narrowed in embodiment "b" of both configuration A and configuration B, in yet another embodiment the ranges are further narrowed in embodiment "c" of both configuration A and configuration B, while a final embodiment narrows the ranges even further in embodiment "d" of both configuration A and configuration B.

In another embodiment the swing speed trainer (50) is a kit and includes at least 4 weights that may be interchangeably placed on, or taken off, the head (100) to also achieve the weight ranges illustrated in Table 1 for embodiment "a" of configuration C, while in a further embodiment the ranges are narrowed in embodiment "b" of configuration C, in yet another embodiment the ranges are further narrowed in embodiment "c" of configuration C, while a final embodiment narrows the ranges even further in embodiment "d" of configuration C.

TABLE 1

Head Weights of Different Head Types and Training Configurations

| Club Type | Head Weight (Grams) | Configuration A (Grams) | Configuration B (Grams) | Configuration C (Grams) |
|---|---|---|---|---|
| Driver | 180-215 | a) 125-185 | a) 185-270 | a) 155-210 |
| | | b) 135-180 | b) 195-265 | b) 165-205 |
| | | c) 145-175 | c) 205-260 | c) 175-200 |
| | | d) 155-170 | d) 215-250 | d) 185-195 |
| 3-Wood | 190-225 | a) 135-195 | a) 195-280 | a) 165-220 |
| | | b) 145-190 | b) 205-275 | b) 175-215 |
| | | c) 155-185 | c) 215-270 | c) 185-210 |
| | | d) 165-175 | d) 225-265 | d) 195-205 |

TABLE 1-continued

| Head Weights of Different Head Types and Training Configurations | | | | |
|---|---|---|---|---|
| Club Type | Head Weight (Grams) | Configuration A (Grams) | Configuration B (Grams) | Configuration C (Grams) |
| 5-Wood | 200-235 | a) 140-200 | a) 205-295 | a) 170-230 |
| | | b) 150-195 | b) 215-290 | b) 180-225 |
| | | c) 160-190 | c) 225-285 | c) 190-220 |
| | | d) 170-185 | d) 235-280 | d) 210-215 |
| 3-Hybrid | 225-250 | a) 160-215 | a) 230-315 | a) 195-245 |
| | | b) 170-210 | b) 240-310 | b) 205-240 |
| | | c) 180-205 | c) 250-305 | c) 215-235 |
| | | d) 190-200 | d) 260-300 | d) 225-230 |

While the above disclosure was associated with the "driver" row of Table 1, it is not necessary to repeat the analogous disclosure associated with the other rows of Table 1 directed to 3-wood, 5-wood, and 3-hybrid. As previously noted, swing speed training is generally associated with the goal of increasing the length of tee shots, the same concept, disclosure, and procedure applies to the other clubs because a golfer may want to increase the distance associated with one of these other clubs in an effort to achieve desirable gapping distances among the clubs throughout the set.

The above disclosure mentions at least 3 weights in a kit or system achieve the desired ranges of configuration A and B, and at least 4 weights achieve the desired ranges of configuration C, more weights are often preferred and provide significantly greater fine tuning of the mass associated with the desired total system weight of swing speed trainer (50). Therefore, one embodiment includes at least 5 weights, and in a further embodiment all 5 weights are different. Another embodiment includes at least 6 weights, which in a further embodiment includes at least 3 different weights. Likewise for embodiments including 7 weights, 8 weights, 9 weights, and even 10 weights, as illustrated in FIG. 1.

Table 2 shows embodiments utilizing weights in which each weight has a unique mass, in other words none of the weights have the same mass as another weight in the kit or system, and the combination is capable of achieving the previously discussed configuration A and B utilizing 3, or more, weights, and also achieves configuration C with 4, or more, weights. Table 3 shows embodiments utilizing weights in which each weight is part of a matching pair of identical weights, and a combination is capable of achieving the previously discussed configuration A and B utilizing 2, or more, pairs of weights, and also achieves configuration C with 3, or more, pairs of weights.

Figure 16:
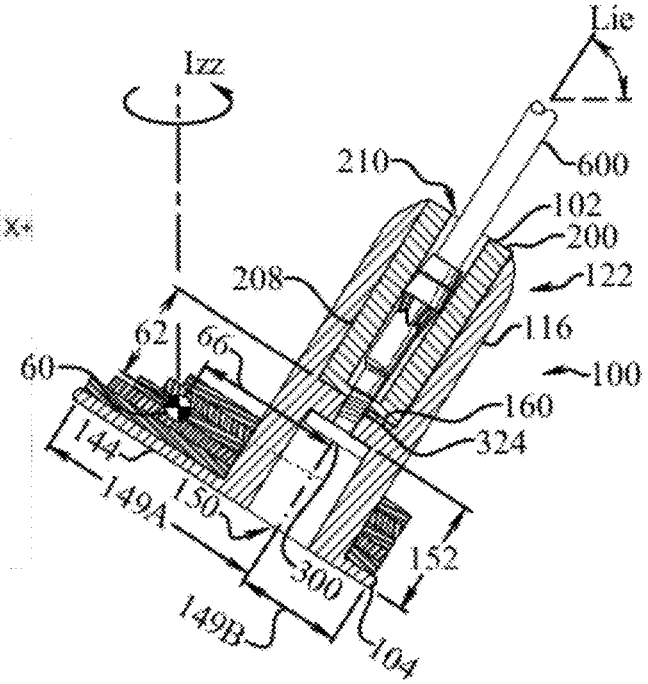
FIG. 16 shows a partial cross-sectional assembled view of an embodiment of the head and sleeve with a shaft oriented at the design lie angle, shaft sleeve, a retainer, and weights.

FIG. 16 shows a vertical axis passing through the system center of gravity (60), when the golf swing speed trainer (50) is oriented at a lie angle of 60 degrees. The moment of inertia of the golf swing speed trainer (50) about the vertical axis is referred to as Izz. In one embodiment, specifically the driver embodiment of Table 1, at least one of configuration A, B, and C have an Izz greater than about 150 kg-mm$^2$, while in another embodiment at least two of configuration A, B, and C have an Izz greater than about 150 kg-mm$^2$, and in a further embodiment all three configurations have an Izz greater than about 150 kg-mm$^2$. In another series of embodiments, specifically the driver embodiment of Table 1, at least one of configuration A, B, and C have an Izz greater than about 200 kg-mm$^2$, while in another embodiment at least two of configuration A, B, and C have an Izz greater than about 200 kg-mm$^2$, and in a further embodiment all three configurations have an Izz greater than about 200 kg-mm$^2$. In another series of embodiments, specifically the driver embodiment of Table 1, at least one of configuration A, B, and C have an Izz greater than about 250 kg-mm$^2$, while in another embodiment at least two of configuration A, B, and C have an Izz greater than about 250 kg-mm$^2$, and in a further embodiment all three configurations have an Izz greater than about 250 kg-mm$^2$. In another series of embodiments, specifically the driver embodiment of Table 1, at least one of configuration A, B, and C have an Izz greater than about 300 kg-mm$^2$, while in another embodiment at least two of configuration A, B, and C have an Izz greater than about 300 kg-mm$^2$, and in a further embodiment all three configurations have an Izz greater than about 300 kg-mm$^2$. In another series of embodiments, specifically the driver embodiment of Table 1, at least one of configuration A, B, and C have an Izz greater than about 400 kg-mm$^2$, while in another embodiment at least two of configuration A, B, and C have an Izz greater than about 400 kg-mm$^2$, and in a further embodiment all three configurations have an Izz greater than about 400 kg-mm$^2$. In another series of embodiments, specifically the driver embodiment of Table 1, at least one of configuration A, B, and C have an Izz greater than about 500 kg-mm$^2$, while in another embodiment at least two of configuration A, B, and C have an Izz greater than about 500 kg-mm$^2$, and in a further embodiment all three configurations have an Izz greater than about 500 kg-mm$^2$.

The golf swing speed trainer (50) is configured such that no combination of the weights available in the kit can produce an Izz greater than about 590 kg-mm$^2$. The Izz of configuration B is no more than 30% greater than the Izz of configuration A, and no more than 25% in another embodiment, and no more than 20% in still a further embodiment, and no more than 15% in a final embodiment. Similarly, the Izz of configuration C is no more than 20% greater than the Izz of configuration A, and no more than 15% in another embodiment, and no more than 10% in still a further embodiment, and no more than 5% in a final embodiment.

TABLE 2

| Golf Swing Speed Trainer Embodiments | | | | |
|---|---|---|---|---|
| Element Number | Example 1 (Grams) | Example 2 (Grams) | Example 3 (Grams) | Example 4 (Grams) |
| 100 | 45-185 | 65-165 | 85-145 | 100-120 |
| 200 | 4-50 | 6-40 | 8-30 | 10-20 |
| 300 | 0.5-5 | 0.625-4 | 0.75-3 | 1-2 |
| 410 | 30-60 | 32-56 | 34-52 | 36-48 |
| 420 | 22-42 | 24-40 | 26-38 | 28-34 |
| 430 | 14-30 | 16-28 | 18-26 | 20-24 |
| 440 | 6-20 | 6-18 | 8-14 | 9-13 |
| 450 | 2-10 | 2-8 | 2-6 | 3-5 |

Now examining the embodiment of Example 1 from Table 2 for golf swing trainers having single weights, the head (100) has a weight that ranges from 45-185 grams, the sleeve (200) has a weight that ranges from 4-50 grams, and the retainer (300) has a weight that ranges from 0.5-5 grams. The first weight (410) has a weight range from 30-60 grams, the second weight (420) has a weight range from 22-42 grams, the third weight (430) has a weight range from 14-30 grams, the fourth weight (440) has a weight range from 6-20 grams, and the fifth weight (450) has a weight range from 2-10 grams. In other words for the embodiment in Example 1, the golf swing speed trainer (50) has a 123.5 gram minimum weight, and a 402 gram maximum weight if all weights were utilized, however the ranges of configuration A and B from Table 1 may be achieved without the need to utilize each of the weights of Table 2. The ranges just disclosed are further narrowed in additional embodiments presented in Table 2 as example 2, example 3, and example 4, which need no further explanation.

TABLE 3

Golf Swing Speed Trainer Embodiments

| Element Number | Example 1 (Grams) | Example 2 (Grams) | Example 3 (Grams) | Example 4 (Grams) |
|---|---|---|---|---|
| 100 | 45-185 | 65-165 | 85-145 | 100-120 |
| 200 | 4-50 | 6-40 | 8-30 | 10-20 |
| 300 | 0.5-5 | 0.625-4 | 0.75-3 | 1-2 |
| 410 | 15-30 | 16-28 | 17-26 | 18-24 |
| 420 | 11-21 | 12-20 | 13-19 | 14-17 |
| 430 | 7-15 | 8-14 | 9-13 | 10-12 |
| 440 | 3-10 | 3-9 | 4-7 | 4.5-6.5 |
| 450 | 1-5 | 1-4 | 1-3 | 1.5-2.5 |

As one can see from the embodiment of Example 1 from Table 3 for golf swing trainers having paired weights, the head (100) has a weight that ranges from 45-185 grams, the sleeve (200) has a weight that ranges from 4-50 grams, the retainer (300) has a weight that ranges 0.5-5 grams, the first weight (410) has a weight range from 15-30 grams, the second weight (420) has a weight range from 11-21 grams, the third weight (430) has a weight range from 7-15 grams, the fourth weight (440) has a weight range from 3-10 grams, and the fifth weight (450) has a weight range from 1-5 grams. In other words for the embodiment in Example 1, the golf swing speed trainer (50) has a 123.5 gram minimum weight, and a 402 gram maximum weight if all weights were utilized, however the ranges of configuration A and B from Table 1 may be achieved without the need to utilize each of the weights of Table 3. The ranges just disclosed are further narrowed in additional embodiments presented in Table 3 as example 2, example 3, and example 4, which need no further explanation.

In a still further embodiment, the mass of the head (100) is greater than the mass of the sleeve (200), which is greater than the mass of the retainer (300). Additionally, in another embodiment the mass of the head (100) is greater than the sum of the weights that may be attached to the head (100). In yet a further embodiment the mass of the head (100) is 35-75% of the total system weight of swing speed trainer (50), and at least 45% in another embodiment, and at least 55% in yet a further embodiment. The mass of the sleeve (200) is less than 25% of the total system weight of swing speed trainer (50) in one embodiment, and less than 15% in another embodiment, and no more than 10% in still a further embodiment.

Conventional speed training devices use very high density materials to keep the size as small as possible. However, this means that such a high density speed training device is significantly smaller in volume than a modern driver club head, which are generally 420-460 cc. The impact of this is that such a high density speed training device does not present an aerodynamic drag profile that golfers are accustomed to and associated with the modern golf club head. Therefore, in one embodiment the swing speed trainer (50) utilizes materials that are significantly less dense than would be logical for such an application. In fact, in one embodiment the density of the head (100) is no more than 5 g/cc, while in an even further embodiment the density of the head (100) is no more than 3 g/cc. In fact, in such embodiments the head (100) may be formed of aluminum alloy, magnesium alloy, titanium alloy, or other non-metallic lightweight materials.

This is also true with respect to the actual weights (410, 420, 430, 440, 450), and accordingly in one embodiment the density of any one, or all of, the weights (410, 420, 430, 440, 450) is less than 8 g/cc, and less than 5 g/cc in another embodiment, and less than 3 g/cc in yet a further embodiment, and less than 2 g/cc in yet another embodiment, and less than 1.25 g/cc in a final embodiment. Using such low density materials for the weights is contrary to conventional thinking, as a very large volume must be used to achieve the target mass, which helps mimic the aerodynamic drag characteristics of a modern driver golf club head. In fact, in one embodiment the density of at least one of the weights has the lowest density of the head (100), sleeve (200), and retainer (300). In one embodiment the density of the sleeve (200) is no more than 8 g/cc, and no more than 6 g/cc in another embodiment, and no more than 4 g/cc in a further embodiment, and no more than 2 g/cc in a final embodiment. The retainer (300) has the highest density of the components of the swing speed trainer (50) in an embodiment. In an embodiment at least one of the weights is primarily composed of non-metallic material, and in a further embodiment the non-metallic material is compressible, and elastic in still a further embodiment. Such embodiments reduce the likelihood of rattling due to weight separation and contact during use.

FIG. 8*b* shows an embodiment of a head (100) without a weighting system (400) installed. It has a system center of gravity (60) located at a position defined by a system CG to sleeve bore flange distance (62) and a system CG to plate distal side distance (64), wherein in some embodiments the system center of gravity (60) is located approximately in-line with a central axis of the spindle bore (130) passing through the center of the spindle bore proximal diameter (134) and the center of the spindle bore distal diameter (136), as one would expect for a symmetrical swing speed trainer (50). The system center of gravity (60) accounts for the head (100), sleeve (200), retainer (300), and the weighting system (400). The system CG to sleeve bore flange distance (62) is measured from the spindle bore flange (160) to the system center of gravity (60), in a direction parallel to the central axis of the spindle bore (130). FIG. 8*c* illustrates an embodiment with the sleeve (200) having a much thicker sleeve bore flange (220), and therefore the system center of gravity (60) is lower and the system CG to sleeve bore flange distance (62) and a system CG to plate distal side distance (64) are less than the values in FIG. 8*b*. As weights are installed, as seen in FIGS. 8*d*-8i, and in different placements, the system center of gravity (60) moves up and down depending on the weights, and accordingly the system CG to sleeve bore flange distance (62) and the system CG to plate distal side distance (64) change. This ability to change the system center of gravity (60) location allows a user to more closely simulate the center of gravity location of their specific club head with respect to the shaft sleeve, which makes the overall setup feel more like the club that the user is familiar with. In one embodiment the reconfiguration of the weights from a bottom heavy configuration, such as that shown in FIG. 8*f*, to a top heavy configuration, such as that shown in FIG. 8*g*, results in a change of the system CG to plate distal side distance (64) of at least 1 mm, and at least 2 mm in another embodiment, and at least 3 mm in a further embodiment, and at least 4 mm in yet another embodiment.

Figure 8E:
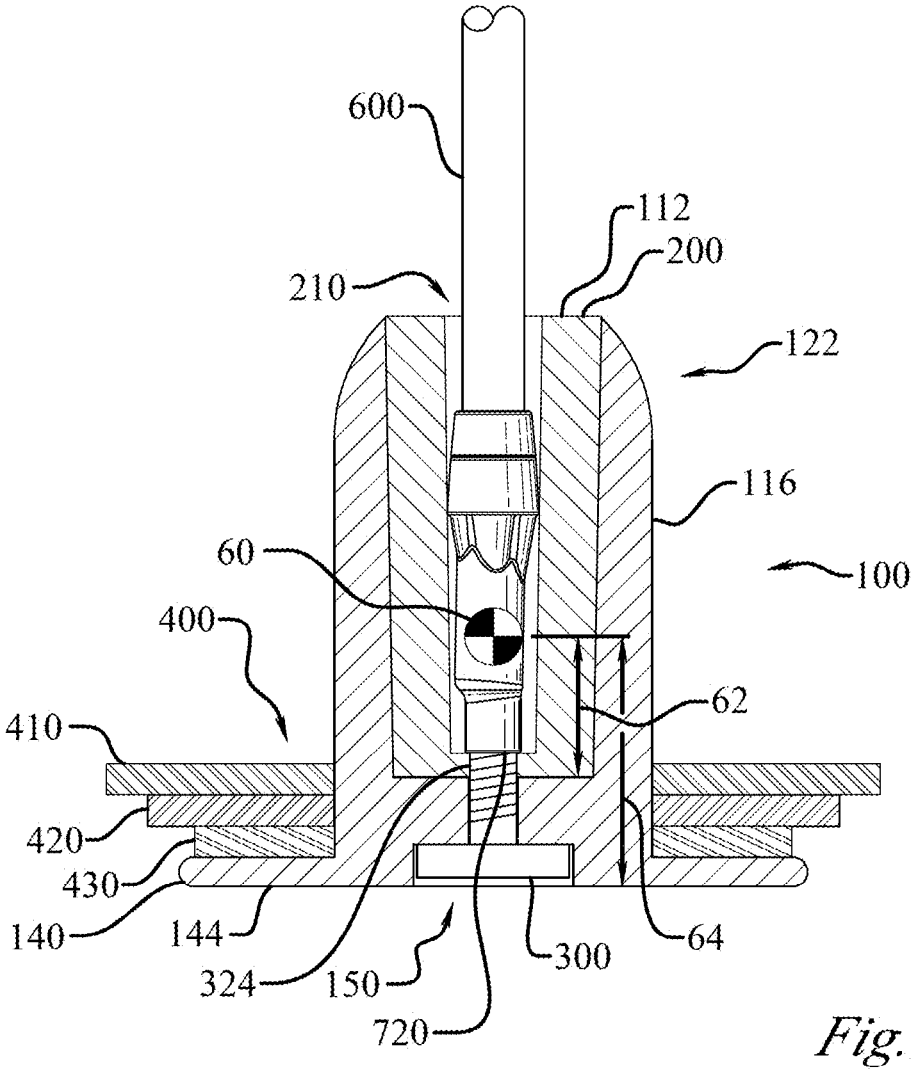
FIG. 8*e* shows a partial cross-sectional assembled view of an embodiment of head and sleeve with a shaft, shaft sleeve, a retainer, and three weights.
Figure 8F:
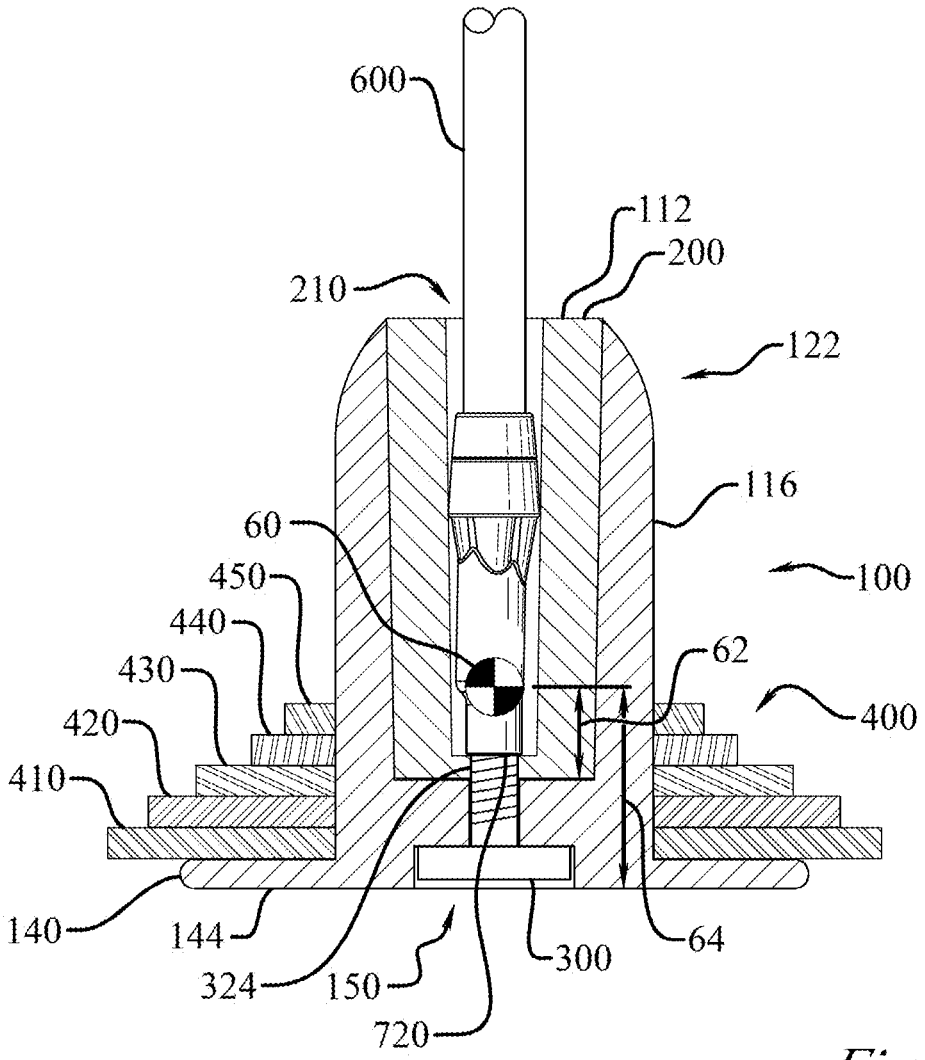
FIG. 8*f* shows a partial cross-sectional assembled view of an embodiment of head and sleeve with a shaft, shaft sleeve, a retainer, and five weights
Figure 8G:
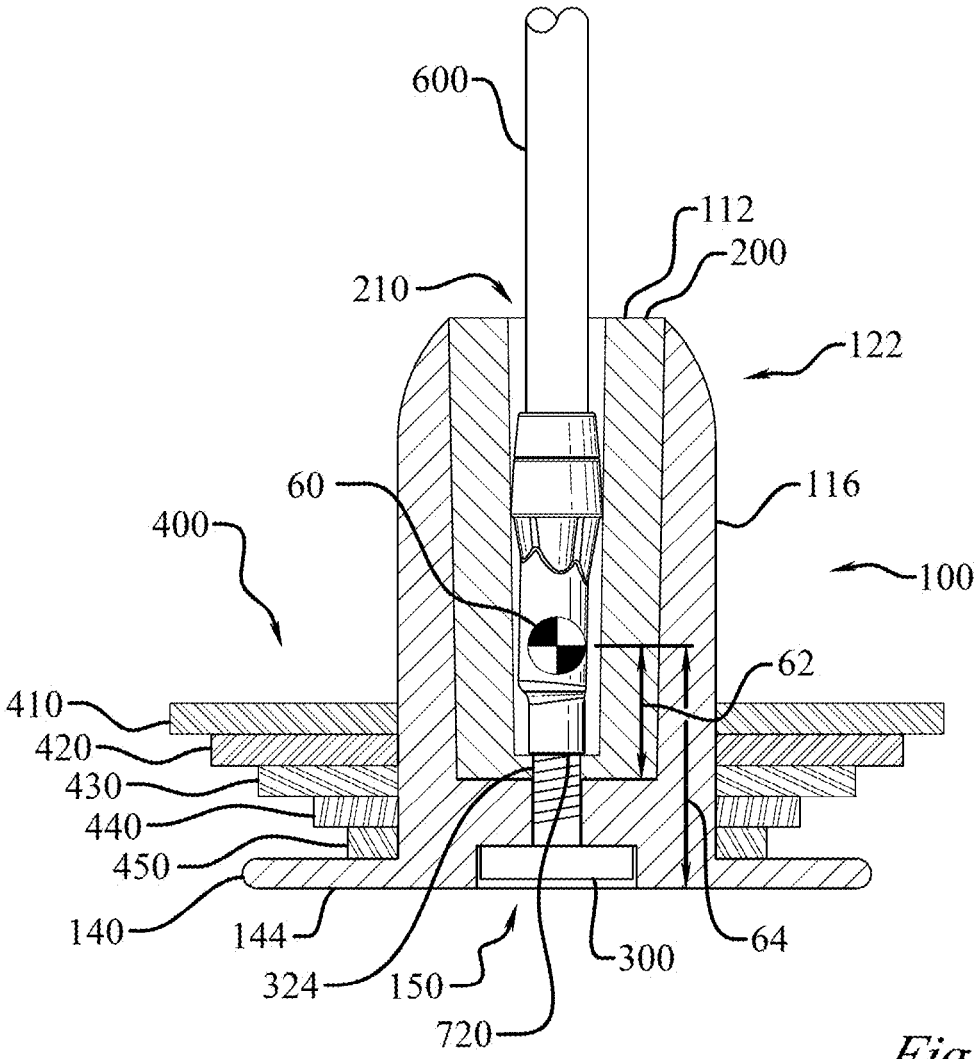
FIG. 8*g* shows a partial cross-sectional assembled view of an embodiment of head and sleeve with a shaft, shaft sleeve, a retainer, and five weights.
Figure 8H:
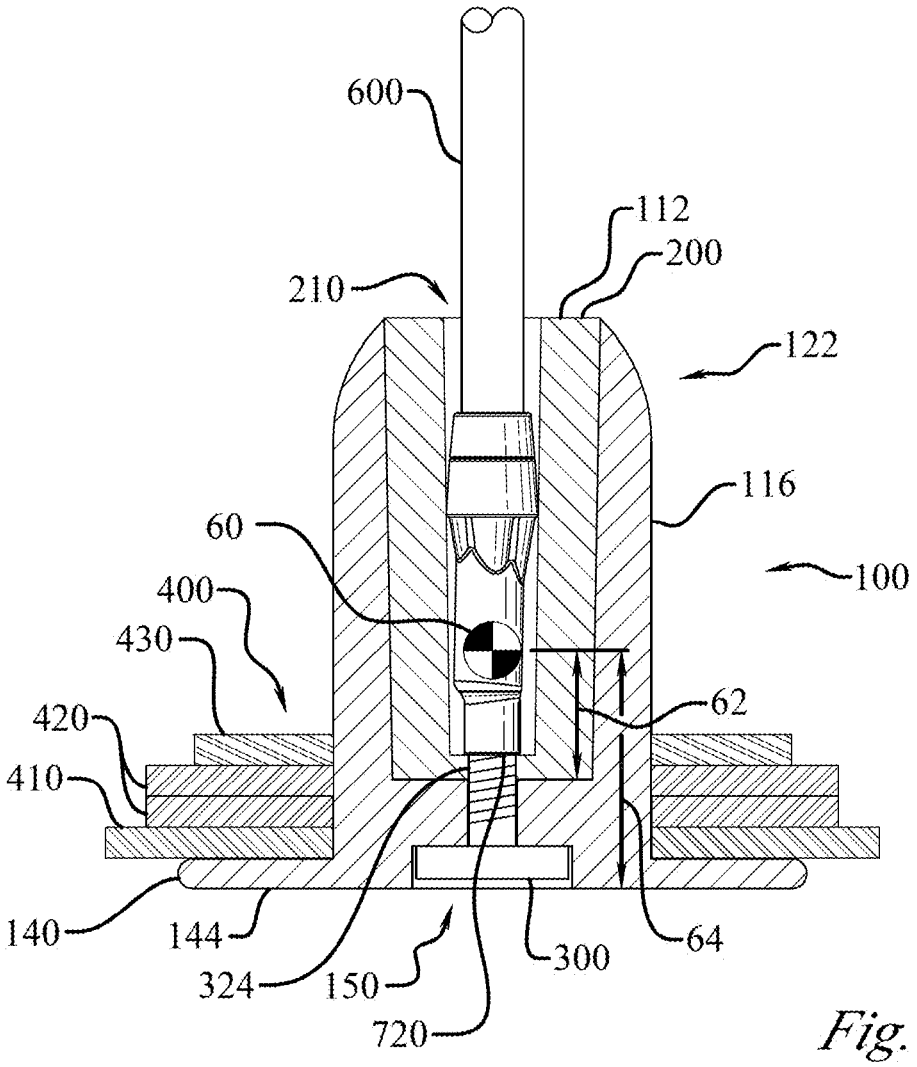
FIG. 8*h* shows a partial cross-sectional assembled view of an embodiment of head and sleeve with a shaft, shaft sleeve, a retainer, and four weights.
Figure 8I:
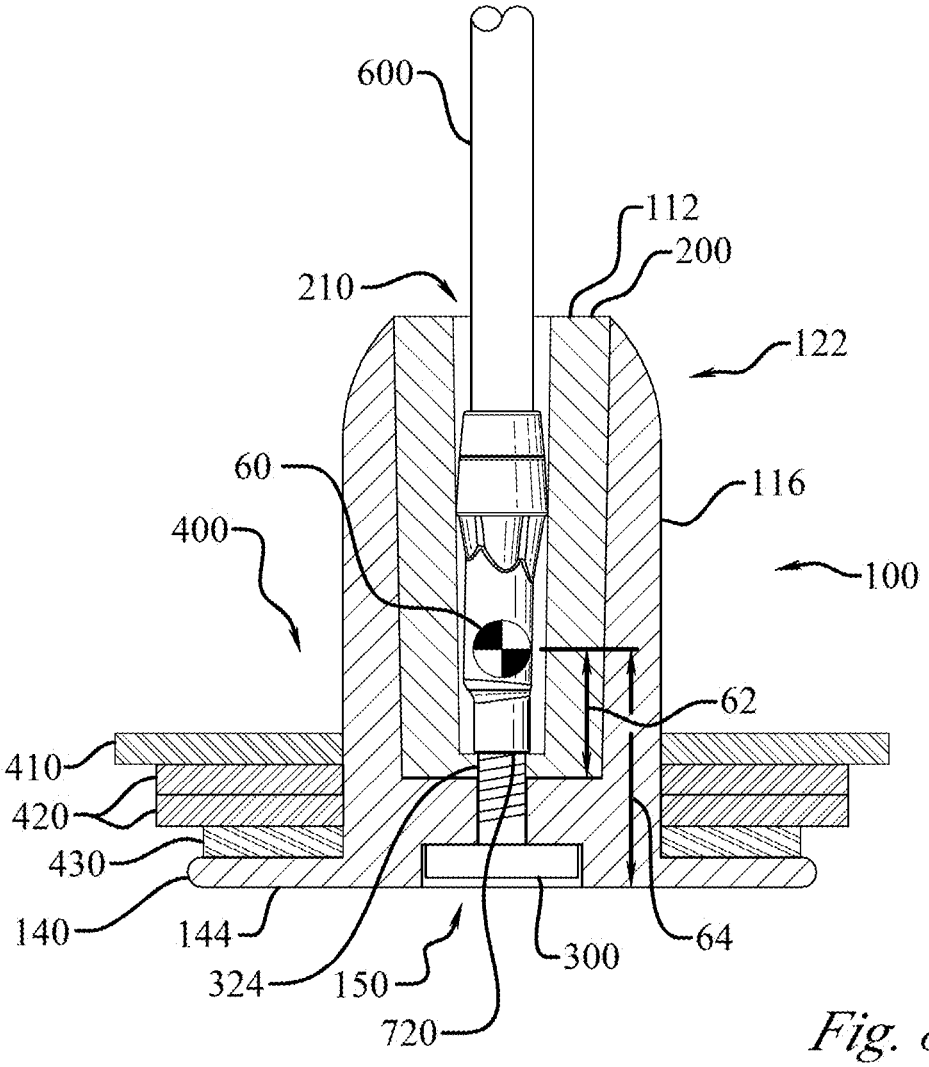
FIG. 8*i* shows a partial cross-sectional assembled view of an embodiment of head and sleeve with a shaft, shaft sleeve, a retainer, and four weights.

FIG. 8*d* shows an embodiment of a head (100) with first weight (410) installed closest to the support plate (140), next a second weight (420), and lastly a third weight (430) installed on top of the second weight (420). FIG. 8*e* shows an embodiment of a head (100) with a third weight (430) installed closest to the support plate (140), next a second weight (420), and lastly a first weight (410) installed on top of the second weight (420). FIG. 8*f* shows an embodiment of a head (100) with first weight (410) installed closest to the support plate (140), next a second weight (420), a third weight (430) installed on top of the second weight (420), a fourth weight (440) installed on top of the third weight (430), and a fifth weight (450) installed on top of the fourth weight (440). FIG. 8*g* shows an embodiment of a head (100) with fifth weight (450) installed closest to the support plate (140), next a fourth weight (440), a third weight (430) installed on top of the fourth weight (440), a second weight (420) installed on top of the third weight (430), and a first weight (410) installed on top of the second weight (420). FIG. 8*h* shows an embodiment of a head (100) with first weight (410) installed closest to the support plate (140), next two second weights (420) are placed on the first weight (410), and a third weight (430) installed on top of the pair of second weights (420). FIG. 8*i* shows an embodiment of a head (100) with a third weight (430) installed closest to the support plate (140), next two second weights (420) are placed on the third weight (430), and a first weight (410) installed on top of the pair of second weights (420).

Figure 10:
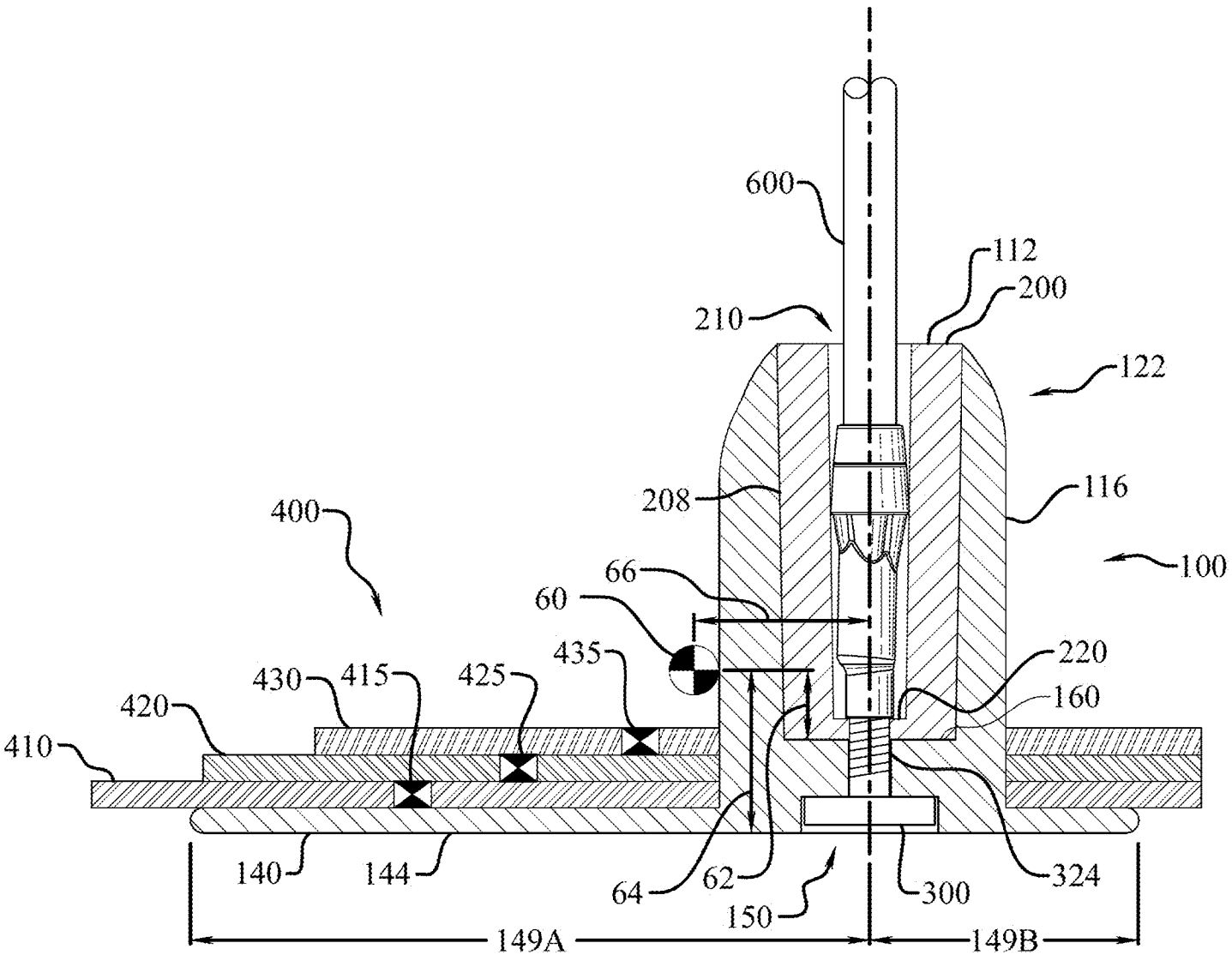
FIG. 10 shows a partial cross-sectional assembled view of an embodiment of head and sleeve with a shaft, shaft sleeve, a retainer, and three weights.

In some embodiments, the weights of the weighting system (400) have a non-symmetric shape about the center of the weight inner diameter (402), as seen in FIGS. 10-13*c*. In such embodiments the center of gravity of each individual weight, best illustrated by 415, 425, and 435 in FIG. 10, is not in-line with the central axis of the spindle bore (130), which shifts the overall system center of gravity (60) to be a system CG from central axis dimension (66). The ability to shift the system CG away from the central axis further allows the swing speed trainer (50) to more closely mimic the mass properties, and therefore feel, of the user's golf club head. One skilled in the art will appreciate the moment of inertia properties of a golf club head, which includes a face-closing moment of inertia, sometimes referred to as a hosel moment of inertia. This moment of inertia is a reflection of the resistance that a golfer experiences during a golf swing in their effort to square-up the club face with the target line at impact. Therefore, providing adjustability not only in terms of the previously described system CG to plate distal side distance (64), but also the system CG from central axis dimension (66), provides the unique ability to tailor the swing speed trainer (50) to more accurately mimic a target club head, which is the club head that the user is comfortable with. In the embodiment of FIG. 1, the weight thickness (406) is at least 2 mm, and at least 3 mm in another embodiment. The weight thickness (406) is no more than 15 mm, and no more than 12 mm in another embodiment, and no more than 10 mm in still another embodiment. The difference between the weight outer diameter (404) and the weight inner diameter (402) is no more than 35 mm, and no more than 30 mm and 25 mm in further embodiments.

FIGS. 10-13*c* show embodiments wherein the weights of the weighting system (400) are not symmetrical. FIG. 10 shows a golf swing trainer (50) having a first weight (410), a second weight (420), and a third weight (430) installed. The first weight (410) has a first weight center of gravity (415), the second weight (420) has a second weight center of gravity (425), and the third weight (430) has a third weight center of gravity (435) that is not in line the central axis of the spindle bore (130). The offset weight center of gravities (415, 425, and 435) shift the system center of gravity away from the central axis of the spindle bore (130) and having a dimension of system center of gravity from central axis (66). FIGS. 11*a*-11*c* show embodiments of first, second and third weights (410, 420, 430) having a weight indexing cog (408) that mates with an indexing boss on the spindle (110). Furthermore, FIGS. 11*a*-11*c* show a first weight center of gravity (415), a second weight center of gravity (425) and a third weight center of gravity (435), and how the weight center of gravity may shift for each weight. FIGS. 12*a*-12*c* show embodiments of first, second and third weights (410, 420, 430) having a weight indexing boss (407) that mates with an indexing cog on the spindle (110). Furthermore, FIGS. 12*a*-12*c* show a first weight center of gravity (415), a second weight center of gravity (425) and a third weight center of gravity (435) and how the weight center of gravity may shift for each weight.

Figure 9:
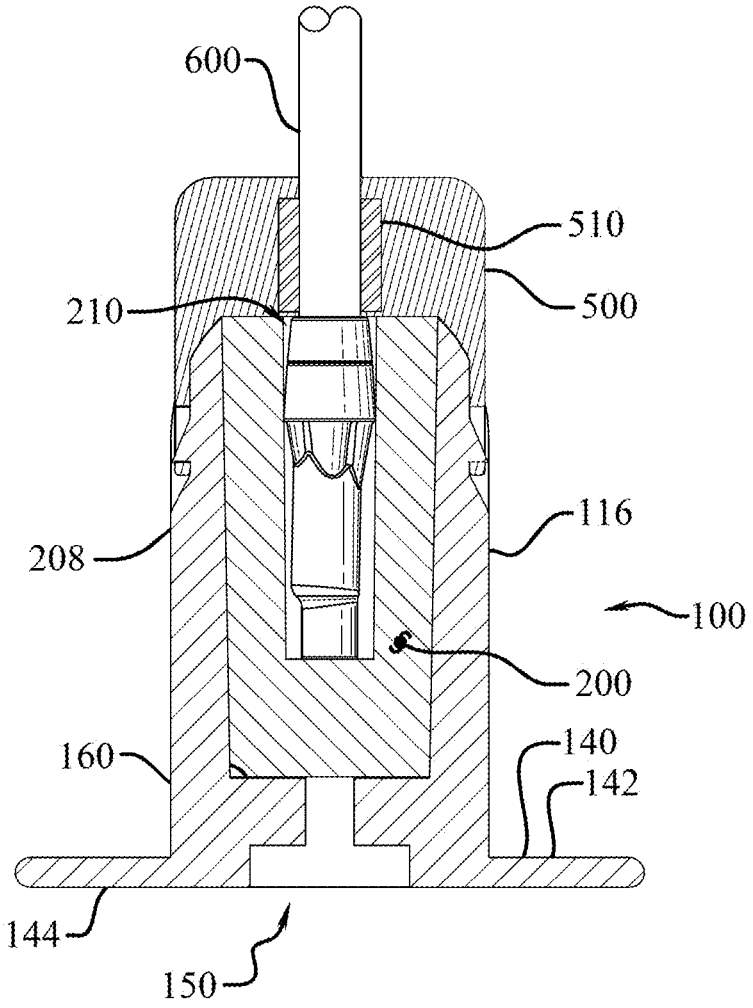
FIG. 9 shows a partial cross-sectional assembled view of an embodiment of head and sleeve with a shaft, shaft sleeve and a shaft retaining cap.
Figure 13A:
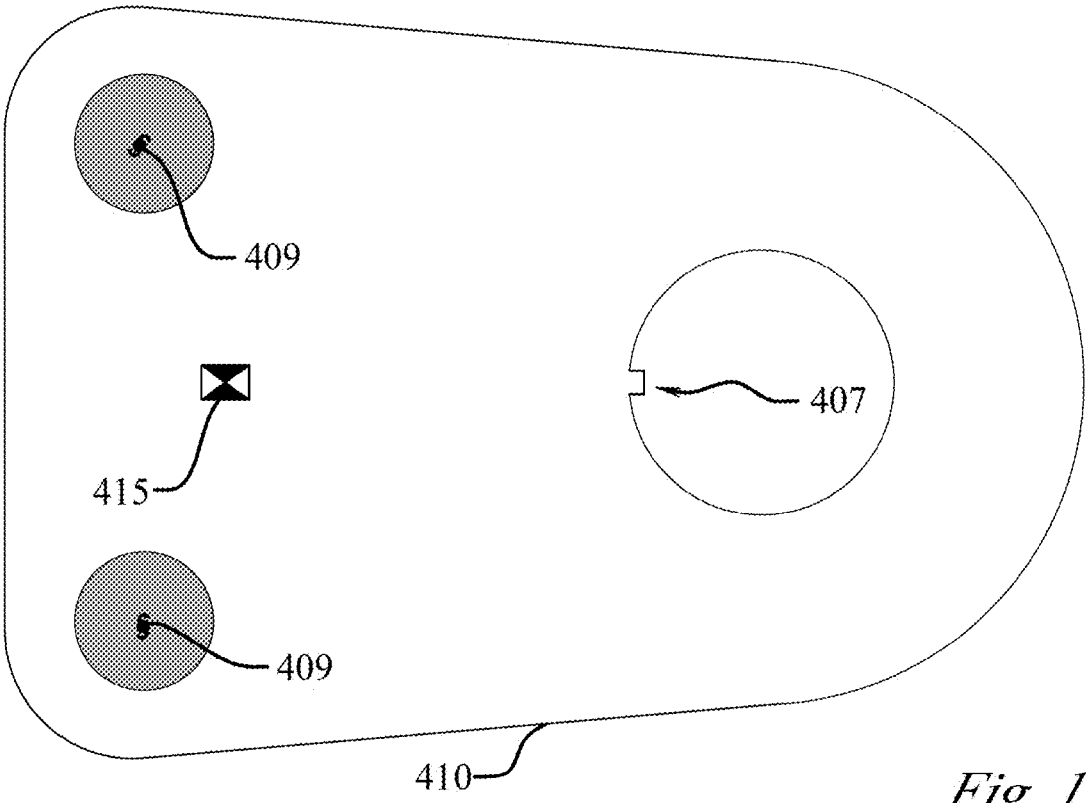
FIG. 13*a* shows a top plan view of a weight embodiment of the present invention having a plurality of higher density portions.
Figure 13B:
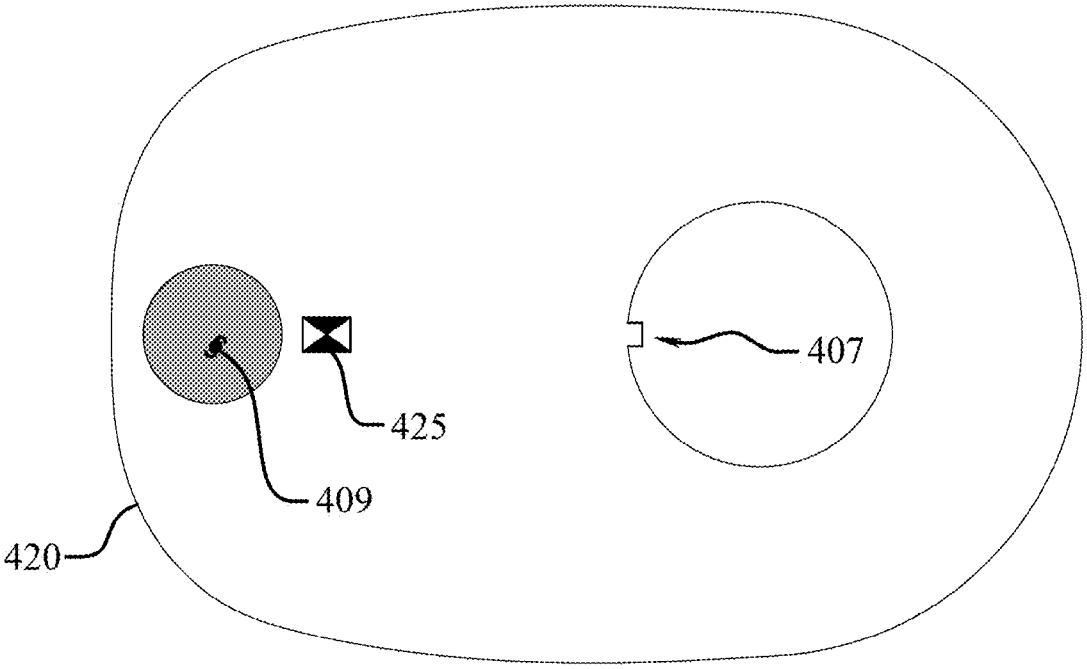
FIG. 13*b* shows a top plan view of a weight embodiment of the present invention having a higher density portion.
Figure 13C:
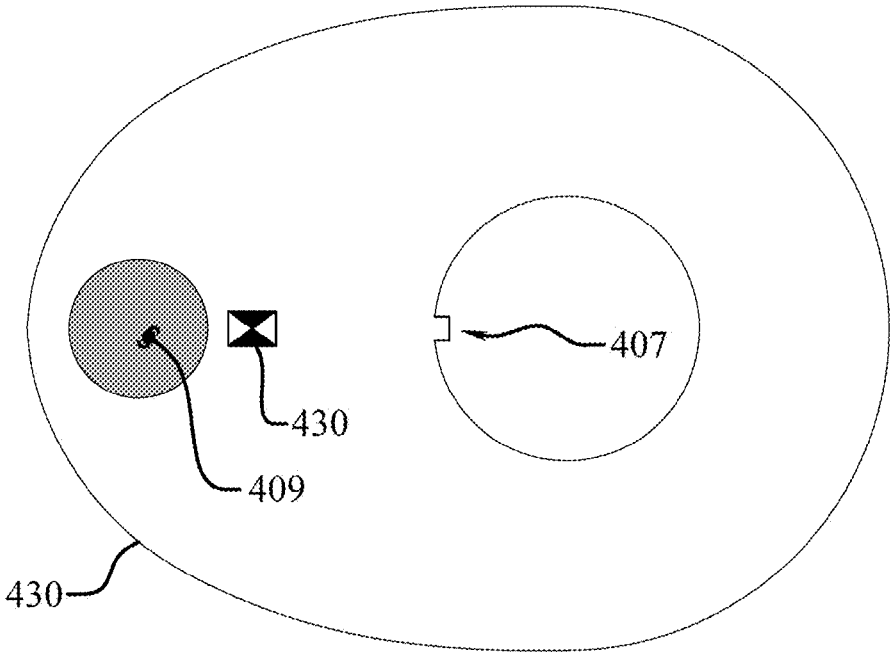
FIG. 13*c* shows a top plan view of a weight embodiment of the present invention having a higher density portion.
Figure 14A:
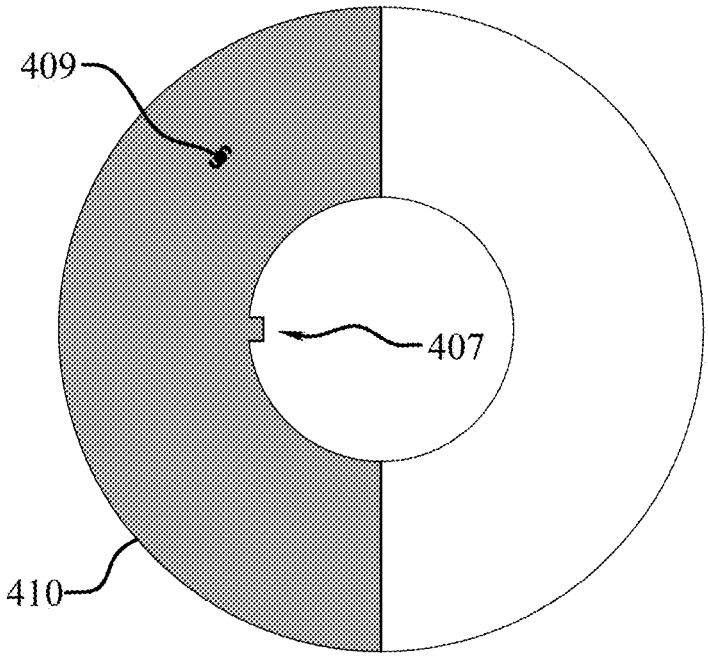
FIG. 14*a* shows a top plan view of a weight embodiment of the present invention having a higher density portion.
Figure 14B:
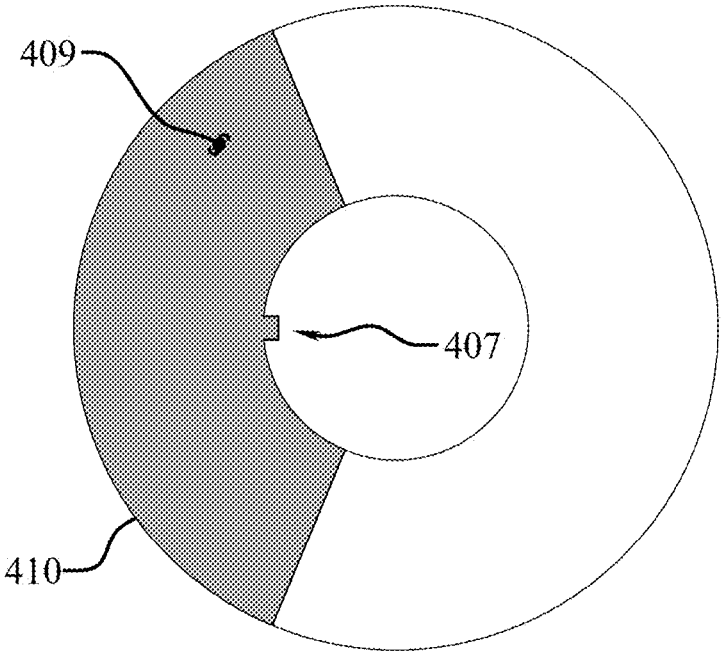
FIG. 14*b* shows a top plan view of a weight embodiment of the present invention having a higher density portion.
Figure 14C:
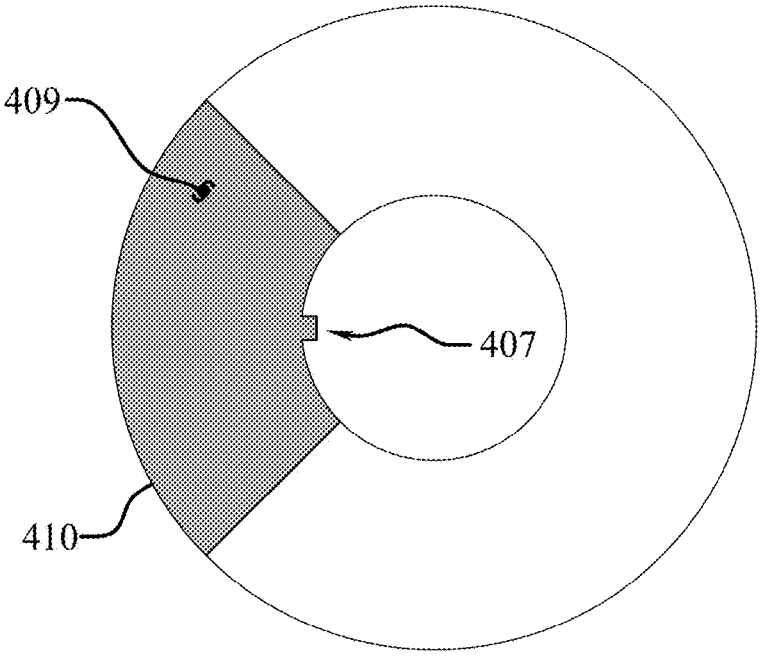
FIG. 14*c* shows a top plan view of a weight embodiment of the present invention having a higher density portion.

FIGS. 13*a*-13*c* show embodiments of first, second and third weights (410, 420, 430) having a weight indexing boss (407) that mates with an indexing cog on the spindle (110). Furthermore, FIGS. 13*a*-13*c* show a first weight center of gravity (415), a second weight center of gravity (425) and a third weight center of gravity (435), and how the weight center of gravity may shift for each weight. Furthermore, the first, second and third weights (410, 420, 430) may have higher density portions (409) that further shift the weight center of gravities (415, 425, 435) and may significantly increase the moment of inertia of the swing speed trainer (50). Such higher density portions have a density that is at least twice the average density of the entire weight, and in one embodiment has a density greater than 7.5 g/cc. FIGS. 14*a*-14*c* show an embodiment of weights that are symmetrical but have weight higher density portions (409) that shift the center of gravity of the weights away from the central axis. FIG. 14*a* is an embodiment wherein ½ of the first weight (410) has a higher density portion (409). FIG. 14*b* is an embodiment wherein ⅓ of the first weight (410) has a higher density portion (409). FIG. 14*c* is an embodiment wherein ¼ of the first weight (410) has a higher density portion (409). Additionally, some embodiments may have a shaft retaining cap (500), seen in FIG. 9, in lieu of a retainer (300). All the prior disclosure applies equally to this embodiment, but with substitution of the shaft retaining cap (500) for the retainer (300). This embodiment may include a shaft retaining cap grommet (510) that frictionally retains a golf club shaft thereby preventing dislodgement, as seen in FIG. 9. The shaft retaining cap grommet (510) may be composed of, but not limited to: rubber, cork, felt, or a combination thereof. The shaft retaining cap (500) of the embodiment in FIG. 9 shows it attached to the head (100) with clips. In another embodiment, not shown, the shaft retaining cap (500) may be attached to the head (100) via threads, clips, cams, and other mechanical joining means.

Figure 15:
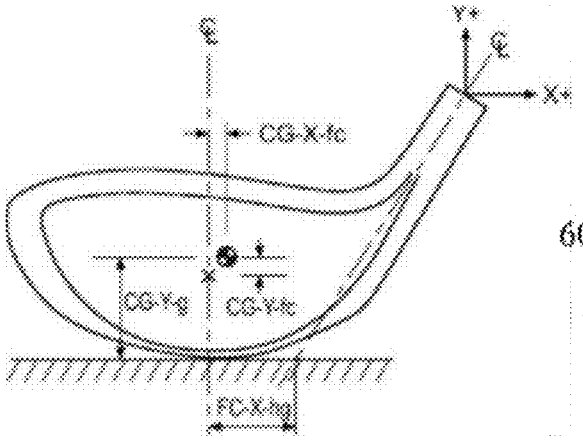
FIG. 15 shows a golf club head with a shaft axis in a design lie angle and illustrating the face center and center of gravity (CG) location and coordinates.

In the most basic embodiments such as that in FIG. 5, the retainer recess depth (152) is as small as 2 mm, or just slightly greater than the retainer head length (314). However, when trying to accurately mimic the center of gravity of a modern driver, as seen in FIG. 15, one skilled in the art will appreciate that a much more significant retainer recess depth (152) is required to get the system center of gravity (60) in the correct position, as seen in FIG. 16. Referring again to FIG. 15, this is because when the shaft sleeve bottoms out in the hosel bore, an imaginary plane that is perpendicular to the shaft axis, and contains the end of the shaft sleeve, would pass above the driver's center of gravity. Thus, the retainer recess depth (152) must get larger, as seen in FIG. 16, so that the support plate (140) is located further from the spindle bore flange (160), and therefore the weights are located further from the spindle bore flange (160). In another embodiment the retainer recess depth (152) is at least 5 mm, and at least 10 mm in yet a further embodiment.

These figures also illustrate the value of having an asymmetric support plate (140) and asymmetric weights. In one such embodiment the asymmetric support plate (140) has a plate long flange length (149A) and a plate short flange length (149B), wherein the plate long flange length (149A) is at least twice the plate short flange length (149B). The difference between the plate long flange length (149A) and plate short flange length (149B) is at least 5 mm, and at least 10 mm in another embodiment, and at least 15 mm in still a further embodiment. The retainer recess depth (152) is at least 20% of the spindle bore depth (132), and at least 40% in another embodiment, and at least 60% in still a further embodiment. However, another series of embodiments recognizes the retainer recess depth (152) is no more than 120% of the spindle bore depth (132), and no more than 100% in another embodiment, and no more than 80% in still a further embodiment.

Figure 17:
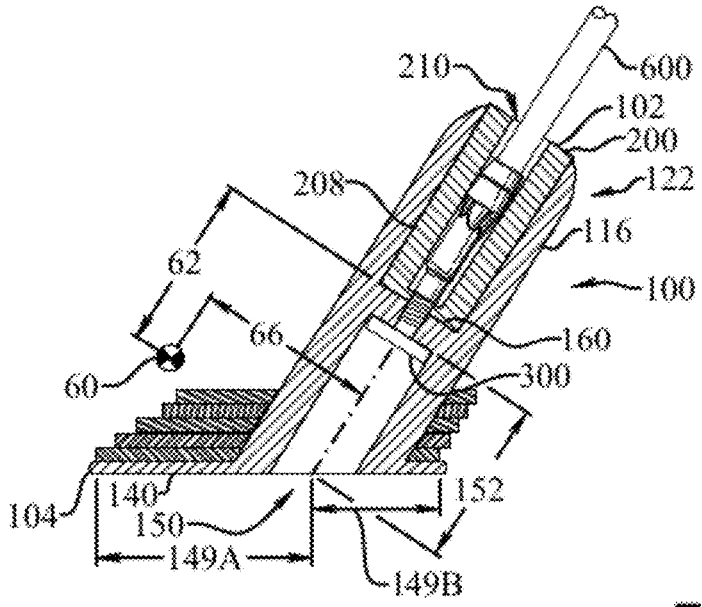
FIG. 17 shows a partial cross-sectional assembled view of an embodiment of the head and sleeve with a shaft oriented at the design lie angle, shaft sleeve, a retainer, and weights.

The system CG to sleeve bore flange distance (62), shown in FIG. 8*b*, is positive when the system center of gravity (60) is located toward the head proximal end (102), and the sleeve bore flange distance (62) is negative when the system center of gravity (60) is located toward the head distal end (104), as seen in FIGS. 16 and 17. The system CG to sleeve bore flange distance (62) is measured in a direction parallel to the central axis of the spindle bore (130).

In some embodiments, such as those of FIGS. 8*b*-8*i*, the system CG to sleeve bore flange distance (62) is positive and the value is less than 50% of the head length (106), and no more than 35% of the head length (106) in another embodiment, and no more than 20% of the head length (106) in yet another embodiment. While in other embodiments, such as those of FIGS. 16 and 17, the system CG to sleeve bore flange distance (62) is negative and is at least 10% of the head length (106), and at least 20% in another embodiment, and at least 30% in still a further embodiment. In further embodiments the system CG to sleeve bore flange distance (62) is no more than 50% of the head length (106), positive or negative, and 40%, 30%, 20%, and 10% in further embodiments. The head length (106) is 20-100 mm in one embodiment, 30-90 mm in another, and 40-80 in still another.

Just as the system CG to sleeve bore flange distance (62) plays a significant role in mimicking the CG location of an actual club head, so too is the system CG from central axis dimension (66), seen in FIGS. 10, 16, and 17, which is measured in a direction perpendicular to the central axis of the spindle bore (130). Locating the system center of gravity (60) away from the central axis of the spindle bore (130) more accurately mimics the feel of an actual golf club and the resistance that a golfer experiences in squaring the club face during a swing. As seen in FIG. 19, the labeled "gravity center" of the club head, more commonly referred to as the club head CG location, is a labeled "distance of gravity center" from the shaft axis and is a 2-dimensional value and does not account for the "depth of the gravity center" labeled in FIG. 18. As embodiments increase the system CG from central axis dimension (66) and approach the FIG. 19 "distance of gravity center" for that user's golf club head, the feel of the swing speed trainer (50) will feel more and more like the resistance the user experiences when swinging their own golf club, after all the swing speed trainer (50) is using the user's own shaft and grip. Therefore, in one embodiment the system CG from central axis dimension (66) is at least 0.25", while in another embodiment it is at least 0.500", and at least 0.750" in a further embodiment, and at least 1.000" in a final embodiment.

Figure 18:
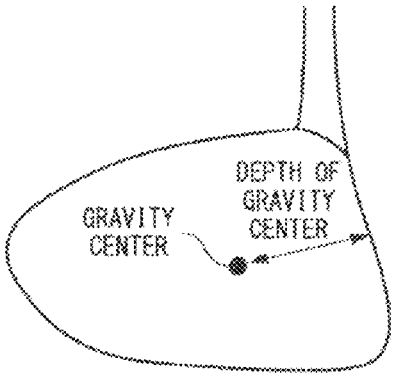
FIG. 18 shows a side elevation view of a golf club head a center of gravity (CG) location and coordinates.
Figure 19:
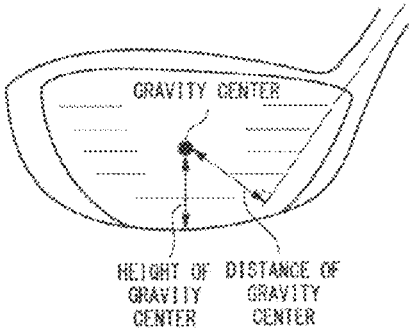
FIG. 19 shows a golf club head with a shaft axis in a design lie angle and illustrating the face center and center of gravity (CG) location and coordinates.

Additional embodiments also take into consideration (a) the "depth of gravity center" seen in FIG. 18, which is also known in the field as a club moment arm, (b) and the "height of gravity center," seen in FIG. 19, and/or (c) the moment of inertia of the user's golf club head. In order to mimic the "depth of gravity center" seen in FIG. 18, an embodiment includes a way to "clock," or repeatably position and secure, the head (100) with respect to the shaft (600) via the shaft sleeve (700), as well as the weighting system (400) with respect to the head (100). The disclosure has already addressed ways of reliably positioning the weights with respect to the head (100), such as the outer shape of the spindle (110) cooperating with the weight inner diameter (402), which may be accomplished solely via the perimeter shapes, or may incorporate cooperating cogs and bosses. Complimentary perimeter shapes include triangles, rectangles, and any polygon, which are also possible exterior perimeter shapes for the weights—however as previously noted the weights to not need to enclose the spindle (110) and the interior and exterior perimeter need not be continuous.

As for repeatably positioning and securing the head (100) to the shaft sleeve (700), in one embodiment the sleeve (200) is specifically configured to cooperate with the shaft sleeve (700), essentially mimicking the cooperating structure and surfaced found in the bore of the associated golf club head. In other words, in this embodiment the sleeve (200) is designed to be specific to a golf club head manufacturer and cooperate with their proprietary shaft sleeves (700). A very basic example is found in U.S. Pat. No. 7,530,900, whereby the sleeve (200) of the present invention may be formed to contain the features of the tube, element 44 of the '900 patent, so that it prevents relative rotation of the shaft sleeve (700) and the sleeve (200), and then the exterior surface of the sleeve (200) includes a sleeve cooperating structure to engage a spindle cooperating structure, formed in the spindle bore (130) or the opening to the spindle bore (130), and may contain indicia to indicate a "home" position, which would be the equivalent to the standard loft and lie position of the club head. Examples of spindle cooperating structures include, but are not limited to, those found in U.S. Pat. Nos. 8,096,895, 9,174,097, 7,344,449, 7,566,279, 9,849,350, 2008/0254909, 7,931,542, 7,997,997, 7,980,959, 7,530,900, 9,320,947, 8,353,781, 7,736,243, 9,320,947, 7,955,182, 8,235,836, 9,782,641, 8,747,248, 9,144,720, 9,908,010, 9,901,787, 8,235,835, 8,616,995, 9,868,035, 9,868,035, as well as universal systems intended to cooperate with the shaft sleeves (700) of numerous different manufacturers such as that disclosed in U.S. Pat. No. 8,046,899, and any of their related family members, all of which are incorporated by reference herein, and any of the features may be incorporated into the present sleeve (200). Specifically, in one embodiment at least a portion of the sleeve bore (210) has a non-circular cross-sectional shape, when the cross-section is taken in a plane perpendicular to the longitudinal axis of the sleeve bore (210).

In the preceding paragraph the sleeve (200) was essentially specific to the shaft sleeve (700) of a particular club head manufacturer, or alternatively included at least one non-rotational feature associated with the shaft sleeve (700) design of multiple manufacturers so it could accommodate more than a single manufacturer, or alternatively included multiple non-rotational features (internally and, in some embodiments, along the entry edge of the spindle bore (130)) to be "universal" an accommodate at least 3 of the shaft sleeves associated with the top 10 selling golf clubs for a particular calendar year. However, an alternative embodiment eliminates the sleeve (200) altogether and the disclosed non-rotation features are formed in the spindle (110). These embodiments highlight the benefits associated with the previously disclosed sleeve (200) that is formed of a material having elastic properties and thereby accepting the shapes of multiple shaft sleeves (700) of different manufacturers. In fact, in one embodiment the kit may include at least two sleeves (200) each having different sleeve bore (210) attributes. In one embodiment a sleeve bore proximal diameter (214) of a second sleeve (200) is at least 10% larger than a sleeve bore proximal diameter (214) of a first sleeve (200). In another embodiment at least a portion of a first sleeve bore (210) has a first cross sectional shape that is different from a second cross sectional shape associated with a portion of a second sleeve bore (210).

In a further embodiment the swing speed trainer (50) includes an app for mobile devices, or a web interface, that allows the user to select the manufacturer and model of their golf club head from a list of options, the app or interface accesses a file containing the appropriate combination of the weighting system (400) including the quantity, size, and placement of the weights needed to achieve a location of the system center of gravity (60) relative to the shaft sleeve distal side (720), or other predefined reference frame, that is no more than ½ from a center of gravity of the selected golf club head relative to the same predefined reference frame. Therefore, the user is instructed on the appropriate combination and orientation to best mimic the user's golf club head. In a further embodiment the ½" is reduced to ¼", and in yet another embodiment it is further reduced to ⅛". A further embodiment incorporates a printed table, or series of tables, to allow a user to look-up the relevant combination.

Figure 3:
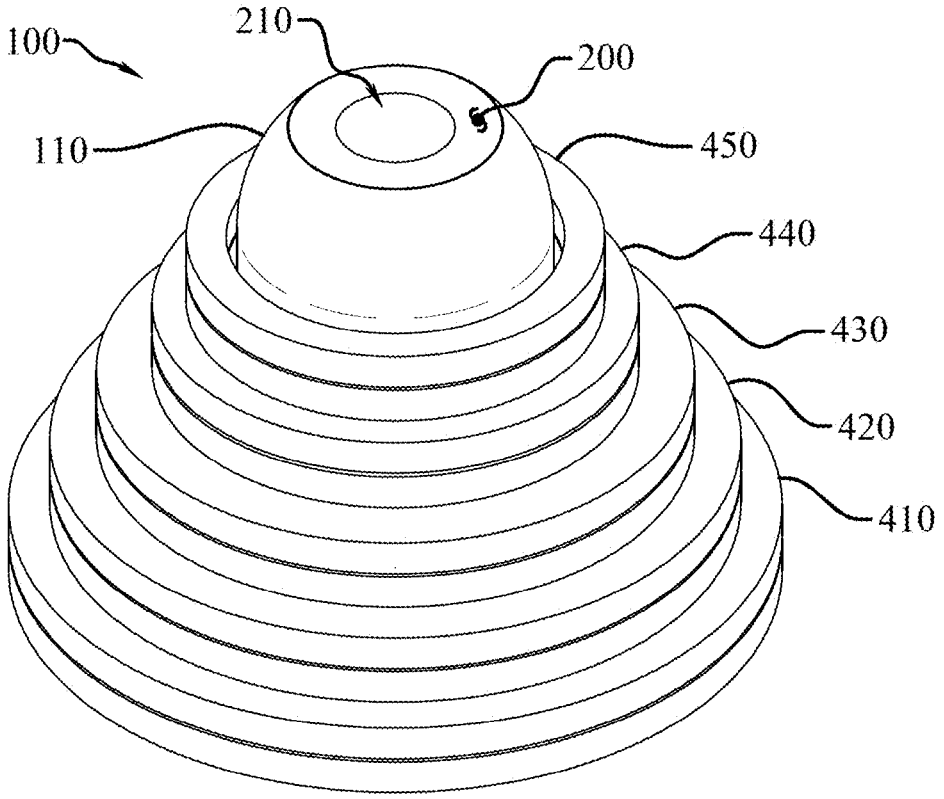
FIG. 3 shows an assembled isometric view of the embodiment of FIG. 1.

As seen in FIG. 17 the support plate (140) is not required to be perpendicular to the central axis of the spindle bore (130), and in fact an angled support plate (140) is beneficial in that it reduces the risk of the user striking the ground with the support plate (140). For instance, orient the embodiments of FIGS. 2 and 3 at the design lie angle, as seen in FIG. 16, and it becomes clear that a portion of the support plate (140) and weighting system (400) is going to project much further from the shaft axis, and toward the ground, than the user is accustomed to when swinging a golf club, as the heel of a golf club curves smoothly from the hosel to the sole and is free of any projections away from the face and toward the ground. In fact, this is another benefit of having a non-uniform support plate (140), specifically one with a long flange portion having a plate long flange length (149A) and a short flange portion having a plate short flange length (149B), as shown in FIG. 16, particularly when the short flange is oriented in a direction indicative of the heel side of a golf club head.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A swing speed trainer (50) for releasable attachment to a shaft sleeve (700) of a golf club shaft (600), comprising:

a head (100), a sleeve (200), a retainer (300), and a weighting system (400);

the head (100) having a head mass, a head proximal end (102), a head distal end (104), and a head length (106), the head (100) includes a spindle (110) having a spindle proximal side (112), a spindle distal side (114), a spindle side wall (116), a spindle length (118), a spindle bore (130) extending into the spindle (110) from the spindle proximal side (112) and having a spindle bore side wall, a spindle bore depth (132), and a spindle bore to spindle sidewall thickness (138), and an aperture extending from the head distal end (104) to the spindle bore (130);

the sleeve (200) having a sleeve mass, a sleeve proximal end, a sleeve distal end, a sleeve length (202), a sleeve side wall (208), a sleeve bore (210) extending into the sleeve (200) from the sleeve proximal end and having a sleeve bore depth (212) and a sleeve bore side wall, a sleeve sidewall thickness (218), and a sleeve bore flange aperture (230) extending into the sleeve (200) from the sleeve distal end and being in communication with the sleeve bore (210), wherein at least a portion of the sleeve (200) is received within the spindle bore (130) such that a portion of the sleeve side wall (208) is in contact with the spindle bore side wall, and at least a portion of the shaft sleeve (700) is received within the sleeve bore (210) and is in contact with the sleeve bore side wall;

the retainer (300) having a retainer mass, wherein a portion of the retainer (300) passes through the aperture and releasably engages the shaft sleeve (700) to secure the shaft sleeve (700) and the sleeve (200) to the head (100);

the weighting system (400), having a total weighting system mass, having a plurality of weights removably mounted on the head (100), wherein the plurality of weights includes at least a first weight, having a first weight mass, and a second weight, having a second weight mass, wherein the first weight mass is not equal to the second weight mass;

the swing speed trainer (50) has a total trainer mass and a system center of gravity (60) located a CG-to-distal-side distance (64) from the head distal end (104); and wherein the head mass is greater than the sleeve mass, and the sleeve mass is greater than the retainer mass.

2. The swing speed trainer (50) of claim 1, wherein the head mass is no more than 185 grams, the sleeve mass is no more than 50 grams, and the total trainer mass is 123.5-402 grams.

3. The swing speed trainer (50) of claim 1, wherein the CG-to-distal-side distance (64) is not equal to one-half of the head length (106).

4. The swing speed trainer (50) of claim 1, wherein the head mass is no more than 75% of the total trainer mass, the sleeve mass is less than 25% of the total trainer mass.

5. The swing speed trainer (50) of claim 1, wherein the head (100) is formed of a head material with a head density of no more than 5 g/cc, the sleeve (200) is formed of a sleeve material with a sleeve density of no more than 3 g/cc and less than the head density.

6. The swing speed trainer (50) of claim 1, wherein the first weight mass is at least twice the second weight mass.

7. The swing speed trainer (50) of claim 1, wherein the plurality of weights are reconfigurably mounted on the head (100), and reconfiguration of at least two of the plurality of weights changes the CG-to-distal-side distance (64) by at least 1 mm.

8. The swing speed trainer (50) of claim 1, wherein with the golf swing speed trainer (50) positioned in a 60 degree lie orientation such that a longitudinal axis of the spindle bore (130) is 60 degrees from a horizontal plane, a moment of inertia (Izz) of the golf swing speed trainer (50) about a vertical axis passing through the system center of gravity (60) is no more than 590 kg-mm$^2$.

9. The swing speed trainer (50) of claim 1, wherein the plurality of weights further includes at least a third weight, having a third weight mass, wherein the third weight mass is not equal to the first weight mass or the second weight mass.

10. A swing speed trainer (50) for releasable attachment to a shaft sleeve (700) of a golf club shaft (600), comprising:

a sleeve (200), a retainer (300), and a weighting system (400);

the sleeve (200) having a sleeve mass, a sleeve proximal end, a sleeve distal end, a sleeve length (202), a sleeve side wall (208), a sleeve bore (210) extending into the sleeve (200) from the sleeve proximal end and having a sleeve bore diameter, a sleeve bore depth (212) of 28-80 mm and a sleeve bore side wall, a sleeve sidewall thickness (218) of at least 2 mm, and a sleeve bore flange aperture (230) extending into the sleeve (200) from the sleeve distal end and being in communication with the sleeve bore (210), the sleeve bore flange aperture (230) having a sleeve bore flange aperture diameter (232) less than the sleeve bore diameter, and defining a sleeve bore flange thickness (222) of at least 1.5 mm, wherein at least a portion of the shaft sleeve (700) is received within the sleeve bore (210) and is in contact with the sleeve bore side wall;

the retainer (300) having a retainer mass, wherein a portion of the retainer (300) passes through the sleeve bore flange aperture (230) and releasably engages the shaft sleeve (700) to secure the sleeve (200) to the shaft sleeve (700);

the weighting system (400) including at least a first weight, a second weight, and a third weight interchangeably mountable on the sleeve (200), the first weight having a first weight mass, a first weight inner diameter, a first weight outer diameter, and a first weight thickness of at least 2 mm, the second weight having a second weight mass, a second weight inner diameter, a second weight outer diameter, and a second weight thickness of at least 2 mm, and the third weight having a third weight mass, a third weight inner diameter, a third weight outer diameter, and a third weight thickness of at least 2 mm, wherein the difference in the first weight outer diameter and the first weight inner diameter is no more than 25 mm, the difference in the second weight outer diameter and the second weight inner diameter is no more than 25 mm, the difference in the third weight outer diameter and the third weight inner diameter is no more than 25 mm, and wherein the first weight mass, the second weight mass, and the third weight mass are unequal; and wherein the sleeve mass is less than at least one of the first weight mass, the second weight mass, and the third weight mass.

11. The swing speed trainer (50) of claim 10, wherein the sleeve mass is no more than 50 grams, at least one of the first weight mass, the second weight mass, and the third weight mass is no more than 60 grams, and a total trainer mass is 123.5-402 grams.

12. The swing speed trainer (50) of claim 10, wherein the sleeve mass is less than 25% of a total trainer mass.

13. The swing speed trainer (50) of claim 10, wherein the first weight mass is at least twice the second weight mass.

14. The swing speed trainer (50) of claim 10, wherein with the golf swing speed trainer (50) positioned in a 60 degree lie orientation such that a longitudinal axis of the sleeve bore (210) is 60 degrees from a horizontal plane, a moment of inertia (Izz) of the golf swing speed trainer (50) about a vertical axis passing through the system center of gravity (60) is no more than 590 kg-mm$^2$.

15. A swing speed trainer (50), comprising:

a head (100) attached to a shaft (600), a retainer (300), and a weighting system (400);

the head (100) having a head mass of no more than 185 grams, a head proximal end (102), a head distal end (104), and a head length (106) of 20-100 mm, the head (100) includes a spindle (110) having a spindle proximal side (112), a spindle distal side (114), a spindle side wall (116), a spindle length (118), and a support plate (140) having a plate thickness (146) of 1.5-12.0 mm and a plate diameter (148) of at least 30 mm, wherein at least a portion of the spindle (110) is round and has a spindle diameter (120);

the retainer (300) having a retainer mass and releasably engaging the head (100); and the weighting system (400), having a total weighting system mass, including at least a first weight, a second weight, and a third weight mountable on the head (100) so that at least one of the first weight, the second weight, and the third weight abut the support plate (140), the first weight having a first weight mass, a first weight inner dimension, a first weight outer diameter, and a first weight thickness of at least 2 mm, the second weight having a second weight mass, a second weight inner dimension, a second weight outer diameter, and a second weight thickness of at least 2 mm, and the third weight having a third weight mass, a third weight inner dimension, a third weight outer diameter, and a third weight thickness of at least 2 mm, wherein the difference in the first weight outer diameter and the first weight inner dimension is no more than 25 mm, the difference in the second weight outer diameter and the second weight inner dimension is no more than 25 mm, the difference in the third weight outer diameter and the third weight inner dimension is no more than 25 mm, and wherein the first weight mass, the second weight mass, and the third weight mass are unequal with the first weight mass being 14-30 grams, the second weight mass being 22-48 grams, and the third weight mass being at least twice the first weight mass.

16. The swing speed trainer (50) of claim 15, wherein the head mass is at least 45 grams.

17. The swing speed trainer (50) of claim 15, wherein the head mass is greater than the retainer mass.

18. The swing speed trainer (50) of claim 15, wherein with the golf swing speed trainer (50) positioned in a 60 degree lie orientation such that a longitudinal axis of the spindle is 60 degrees from a horizontal plane, a moment of inertia (Izz) of the golf swing speed trainer (50) about a vertical axis passing through the system center of gravity (60) is no more than 590 kg-mm$^2$.

19. The swing speed trainer (50) of claim 15, further including a fourth weight mountable on the head (100) having a fourth weight mass, a fourth weight inner dimension, a fourth weight outer diameter, and a fourth weight thickness of at least 2 mm, wherein the difference in the fourth weight outer diameter and the fourth weight inner dimension is no more than 25 mm, and wherein the fourth weight mass is unequal to first weight mass, the second weight mass, and the third weight mass.

20. The swing speed trainer (50) of claim 19, further including a fifth weight mountable on the head (100) having a fifth weight mass, a fifth weight inner dimension, a fifth weight outer diameter, and a fifth weight thickness of at least 2 mm, wherein the difference in the fifth weight outer diameter and the fifth weight inner dimension is no more than 25 mm, wherein the fifth weight mass is unequal to first weight mass, the second weight mass, the third weight mass, and the fourth weight mass, wherein at least three of the weights have weight thicknesses of 3-15 mm.

* * * * *